US011903461B2

(12) United States Patent
Selbe et al.

(10) Patent No.: US 11,903,461 B2
(45) Date of Patent: Feb. 20, 2024

(54) JEWELRY CLASP

(71) Applicant: Pandora A/S, Copenhagen (DK)

(72) Inventors: Jean-Pierre Phouthapanya Selbe, Khet Pravet (TH); Koumanotham Abhay, Copenhagen (DK); Punnakaphun Wangphaisal, Copenhagen (DK); Kidsakorn Judto, Copenhagen (DK)

(73) Assignee: Pandora A/S, Copenhagen (DK)

( * ) Notice: Subject to any disclaimer, the term of this patent is extended or adjusted under 35 U.S.C. 154(b) by 0 days.

(21) Appl. No.: 17/995,395

(22) PCT Filed: Dec. 15, 2020

(86) PCT No.: PCT/EP2020/086233
§ 371 (c)(1),
(2) Date: Oct. 3, 2022

(87) PCT Pub. No.: WO2021/197656
PCT Pub. Date: Oct. 7, 2021

(65) Prior Publication Data

US 2023/0172325 A1 Jun. 8, 2023

(30) Foreign Application Priority Data

Apr. 3, 2020 (EP) ..... 20167974

(51) Int. Cl.
*A44C 5/20* (2006.01)

(52) U.S. Cl.
CPC ..... *A44C 5/2052* (2013.01); *A44D 2203/00* (2013.01)

(58) Field of Classification Search
CPC ..... A44C 5/2052; A44D 2203/00; A44B 11/2511
See application file for complete search history.

(56) References Cited

U.S. PATENT DOCUMENTS 2,629,156 A 2/1953 Irving et al.
2,648,884 A 8/1953 Elston
(Continued)

FOREIGN PATENT DOCUMENTS

CH 676073 A3 6/1991
CN 205390592 U 7/2016
(Continued)

*Primary Examiner* — Robert Sandy
(74) *Attorney, Agent, or Firm* — AVEK IP, LLC

(57) ABSTRACT

A jewelry clasp includes a clasp shell enclosing a spacing, the clasp shell having a first opening for slidably receiving a first end of an elongated member; and a spring-biased push button slidably received in the spacing through a second opening, the button being slidable between a releasing state and a locking state, wherein the button has a hole for receiving the first end of the elongated member when the first end is received through the first opening of the clasp shell, wherein the push button further comprises a stopper, the stopper releasing the first end of the elongated member when the button is in the releasing state; and a magnet exerting a magnetic force which, when the first end of the elongated member includes a magnetic material, acts to pull said first end of the elongated member through the first opening and into the hole of the button.

21 Claims, 8 Drawing Sheets

(56) References Cited

U.S. PATENT DOCUMENTS

| | | | | |
|---|---|---|---|---|
| 2,946,237 | A | 7/1960 | Hebert | |
| 3,187,602 | A | 6/1965 | Geoffrey | |
| 3,765,064 | A * | 10/1973 | Hoober | A44C 5/2052 24/658 |
| 3,766,346 | A | 10/1973 | Alexander | |
| 4,001,923 | A * | 1/1977 | Frankel | A44C 5/2052 24/665 |
| 4,161,637 | A | 7/1979 | Priesemuth | |
| 4,924,562 | A | 5/1990 | Pogharian | |
| 6,145,171 | A | 11/2000 | Hoshino | |
| 6,481,069 | B1 | 11/2002 | Cheng | |
| 6,484,376 | B1 | 11/2002 | Khatchadourian et al. | |
| 6,508,080 | B1 | 1/2003 | Ninomiya | |
| 7,082,651 | B2 | 8/2006 | Ninomiya | |
| 7,322,076 | B2 | 1/2008 | Ninomiya | |
| 7,878,024 | B2 | 2/2011 | Baik | |
| 9,326,569 | B1 | 5/2016 | Cipolla | |
| 9,743,725 | B2 | 8/2017 | Hines et al. | |
| 10,722,005 | B1 * | 7/2020 | DiPietro | A44C 5/2052 |
| 2005/0183249 | A1 * | 8/2005 | Ninomiya | A44C 5/2052 24/658 |
| 2005/0188512 | A1 | 9/2005 | Ninomiya | |
| 2007/0240452 | A1 | 10/2007 | Beard | |
| 2014/0020214 | A1 * | 1/2014 | Ayvazian | A44C 5/2052 24/303 |
| 2014/0053374 | A1 | 2/2014 | Jepsen | |
| 2016/0113360 | A1 | 4/2016 | Hines et al. | |

FOREIGN PATENT DOCUMENTS

| | | | |
|---|---|---|---|
| DE | 102011086960 | A1 | 5/2013 |
| DE | 202014001624 | U1 | 5/2015 |
| DE | 102016115716 | A1 | 3/2018 |
| DE | 202018102432 | U | 8/2018 |
| JP | H03284216 | A | 12/1991 |
| JP | 3250091 | B2 | 1/2002 |
| JP | 2003230413 | A | 8/2003 |
| JP | 5191912 | B2 | 5/2013 |
| KR | 101426023 | B1 | 8/2014 |
| WO | 0232249 | A2 | 4/2002 |
| WO | 2015128074 | A1 | 9/2015 |
| WO | 2016069565 | A1 | 5/2016 |
| WO | 2021197656 | A1 | 10/2021 |

* cited by examiner

JEWELRY CLASP

CROSS-REFERENCE TO RELATED APPLICATIONS

This application is the national phase of, and claims priority to, International Application No. PCT/EP2020/086233, filed Dec. 15, 2020, which claims priority to European Application No. 20167974.3, filed Apr. 3, 2020, the disclosure of each of which is incorporated by reference herein in its entirety.

FIELD OF THE INVENTION

The invention relates to jewelry clasps for securing a first end of an elongated member of a bracelet or a necklace to a second end of the elongated member.

BACKGROUND

Jewelry, such as bracelets and necklaces, traditionally comprises freely movable ornamental components, e.g. beads or charms, strung on one or more elongated members. An elongated member may be a chain, wire, string, thread, chord, or the like. Such bead-carrying jewelry has been known since antiquity. Ends of the elongated member are traditionally attached together permanently to prevent the one or more beads from falling off. However, when worn by a user today, the ends of an elongated member of modern jewelry are typically temporarily attached to each other by means of a jewelry clasp. Such jewelry clasps are commonly used in bracelets and necklaces.

With some prior art jewelry clasps locking and unlocking the jewelry clasp without requiring the assistance of a second person may be difficult. This may especially be the case for bracelets worn on the wrist since this often leaves only the other hand for engaging the jewelry clasp, but this may also be perceived as a problem in other types of jewelry, such as necklaces. Therefore, some users prefer jewelry clasps that may easily be locked and unlocked using only one hand without imposing a risk for accidental separation of the ends of the piece of jewelry when the jewelry is worn.

Varieties of jewelry safety clasps for preventing the inadvertent opening of the clasp are also known in the prior art.

U.S. Pat. No. 6,484,376 discloses a jewelry safety clasp including a female and a male member, which in a locked position prevent a shaft from moving axially with respect to a housing of the clasp. A push button and an oppositely positioned spring are included in the clasp.

U.S. Pat. No. 2,629,156 discloses a safety catch intended for necklaces, and which releases and ejects a male part of the catch upon pressure, so that the catch cannot be unlocked accidentally unless a double locking means of the catch is compressed. Two buttons are pushed against springs to release an end cap.

Some prior art jewelry safety clasps have a bulky size and a complicated structure that requires a specific configuration for the ends of the piece of jewelry that are to be held together. Furthermore, if the lock fails, the clasp may not operate safely, imposing a risk for the user of losing the piece of jewelry.

SUMMARY

The jewelry clasps according to this disclosure may allow a piece of jewelry to be worn and taken off without causing any substantial damage to the jewelry. The jewelry clasps according to this disclosure may allow holding ends of an elongated member of a piece of jewelry together.

A bracelet is a piece of jewelry that is typically worn on the wrist of a user (a wrist bracelet), typically at least partly surrounding the wrist. A bracelet may also be worn on the ankle (an ankle bracelet or "anklet"), whereas a necklace is typically worn on the neck of a user.

Jewelry clasps may comprise or consist of metal (e.g. silver, iron, gold, brass, or alloys thereof, such as steel), plastic, glass, precious stones or gemstones, wood. Some jewelry clasps are intended to be hidden while worn, while others form a key element in the design of the jewelry.

Examples of jewelry clasps include a bead clasp, ball clasp, lobster or lobster claw clasp, toggle clasp, barrel clasp, push button clasp, magnetic clasp, snap-lock clasp, etc.

Jewelry safety clasps typically include one or more mechanisms or devices that prevent an unintentional opening of the clasp and provide a more secure wearing of the piece of jewelry.

According to a first aspect of the invention, a jewelry clasp for securing a first end of an elongated member of a bracelet or a necklace to a second end of the elongated member includes a clasp shell enclosing a spacing, the clasp shell having a first opening for slidably receiving the first end of the elongated member for releasably securing the first end to the second end of the elongated member; and a spring-biased push button slidably received in the spacing through a second opening of the clasp shell, the button being slidable between a releasing state and a locking state so that the button can be pushed into the releasing state when a push force against a spring force is applied to the button, the button returning to the locking state by means of the spring force when the push force is released. The push button has a hole for receiving the first end of the elongated member when the first end is received through the first opening of the clasp shell. The push button further comprises a stopper for engaging and locking the first end of the elongated member to the clasp when the first end is positioned in the hole and the push button is in the locking state, the stopper releasing the first end of the elongated member when the push button is in the releasing state. The jewelry clasp further includes a magnet, the magnet exerting a magnetic force which, when the first end of the elongated member includes a material magnetically attractable by the magnet, acts to pull said first end of the elongated member through the first opening and into the hole of the button when said first end is positioned in said first opening.

With a jewelry clasp with the above characteristics, a safer and easier to wear jewelry clasp may be provided, which may further enable a user to lock and unlock the jewelry clasp using only one hand, while the risk of it becoming accidentally unlocked may be reduced.

Such a jewelry clasp may enable a secure attachment of the first end of the elongated member to the jewelry clasp and/or to the second end of the elongated member, whereby a risk of accidentally unlocking said first end may be reduced. Furthermore, such a jewelry clasp may enable a user to lock and release said first end from the jewelry clasp using only one hand. In addition, such a jewelry clasp may allow said first end to be more readily attached to the jewelry clasp, especially due to the magnet's attraction of said first end into said first opening and said hole.

In a second aspect, a piece of jewelry such as a bracelet or a necklace comprising a jewelry clasp is provided.

In a third aspect, a method for assembly of a jewelry clasp is provided.

In a fourth aspect, a method for opening a piece of jewelry is provided.

In a fifth aspect, a method for closing a piece of jewelry is provided.

A length direction can be defined as a direction in which the first end of the elongated member moves when being inserted into or being extracted from the jewelry clasp. A pushing direction of a push force on the push button acting to release the first end of the elongated member from the jewelry clasp can be a direction at an angle to, potentially perpendicular, to the length direction.

The clasp shells of the invention may be or comprise a housing, a casing or a circumferentially extending wall. A shape of the clasp shell may be substantially round and/or spherical, parallelepipedal, ellipsoidal or any other suitable shape. The clasp shell may be made of a hard and/or rigid and/or solid and/or robust material. The clasp shell may comprise or consist of metal, such as silver, iron, gold, brass, or a metal alloy, potentially including one or more of these, such as steel or a silver alloy, a plastic or plastic polymer material, glass, precious stone or gemstone, wood, or any other suitable material. The clasp shell may be coated or plated, such as gold-plated. The clasp shell may comprise or consist of a substantially annularly or spherically shaped wall. The clasp shell may be in one piece and/or integrally shaped, potentially having a beveled configuration and/or comprising annular wall sections. The clasp shell may comprise an exterior and/or an interior surface, wherein the interior surface may be beveled at a lower end of the clasp shell. The clasp shell may be spherical, ellipsoidal, conical, or cylindrical.

The clasp shells of the invention may enclose a spacing. The spacing may be located in an upper part of the clasp, a lower part of the clasp or throughout the clasp shell. The spacing may be a through hole in the clasp shell.

The clasp shells of the invention may enclose, encase, or house the spring, an entire or a major part of the push button, the stopper, and/or the magnet. In a piece of jewelry including the jewelry clasp and an elongated member, the first end of the elongated member may be at least partly enclosed, encased, or housed in the clasp shell in a closed position of the piece of jewelry.

The clasp shells of the invention may comprise a top, a bottom positioned oppositely from the top, a first side, and a second side, each of the first and second sides connecting the top and bottom. The first and the second side may be positioned oppositely from each other. A top part of the push button may be positioned near the top of the clasp shell; a bottom part of the push button near the bottom. The clasp shells of the invention may comprise a first opening and a second opening. The first opening may be positioned at or in the first side of the clasp shell. The first end of the elongated member may be received or be receivable in the first opening. The second opening may be positioned at the top of the clasp shell. The top of the clasp shell may be positioned at an upper part of the clasp shell. The sides of the clasp shell may be positioned oppositely from each other. A center of the top of the clasp shell may be positioned on a line segment that intersects the top and divides the clasp shell into two parts, potentially of substantially the same size. If the clasp shell is spherical, the first and second openings may be located at positions at a right angle to each other, the angle being measured from a center of spherical clasp shell. The second opening may extend into and/or provide access to the spacing. The clasp shell may also comprise a further, third opening. The third opening may be positioned oppositely from the first opening at or in the second side of the clasp shell. The second opening may have a diameter that is smaller than, larger than or equal to a diameter of the first opening. A diameter of the second opening may be two to three times larger than a diameter of the first opening. A diameter of the third opening may be of equal size to a diameter of the first opening.

The spring-biased push buttons of the invention may be received in the spacing of the clasp shell through the second opening of the clasp shell. The spring force acting on the push button may arise from a spring, which may comprise an elastic material. The spring may bias the push button at least in the releasing state. The push button may be spring biased towards the locking state by a spring force of the spring. The spring may be mounted at a lower part of the button, potentially oppositely from the second opening, potentially in a position between the push button and an interior surface of the clasp shell. Alternatively or additionally, the spring may be mounted on a lower part of an interior portion of the clasp shell. The spring may abut at one end a lower surface of the push button and at another end an interior surface of the clasp shell. The spring force may be applied to act against the push button. The spring may be a compression spring, extension spring, torsion spring, coil spring, leaf spring, or any other suitable type of spring. A thickness of a wire of a coil spring may be 0.1 to 0.5 mm.

The push buttons of the invention may comprise or consist of metal or a metal alloy, such as silver, iron, gold, or brass, a metal alloy potentially including one or more of the latter, such as steel or a silver alloy, and/or a plastic or plastic polymer material, glass, precious stone or gemstone, wood, or any other material suitable for wearable jewelry. The push buttons may be coated or plated, such as gold-plated, and/or may comprise an engraving. They may comprise one or more cylinder cell sections and/or openings or apertures. The push buttons may comprise a hole for receiving the first end of the elongated member. The first end may be received in the hole of the push button in the releasing/and or locking state of the push button. The hole may be positioned in a lower part of the push button, potentially near the bottom of the clasp shell, and/or below a push surface of the push button. The push surface may be located near the top of the clasp shell. A size or diameter or a cross-sectional extent of the hole may be substantially equal to a size or a diameter or a cross-sectional extent of the first opening of the clasp shell.

The push buttons of the invention may include a push surface positioned on a top end of the jewelry clasp, this top end being accessible from outside the jewelry clasp so that when the push surface is pushed e.g. by a finger of a user, the push button may be pushed or forced from the locking position towards the releasing state against the spring force. If the first end of the elongated member is not inserted or is fully inserted and locked in the jewelry clasp, the push button may return by means of the spring bias to the locking state. In the releasing state, the push surface may be pushed somewhat into the second opening and/into the spacing. The push surface may in the locking state be positioned in alignment with an exterior surface of the clasp shell. The push surface may be a rounded surface and/or may continue a shape of the clasp shell in the locking state and/or may substantially cover the second opening in the locking state. An outer shape of the push surface may substantially follow a curvature or shape of an exterior surface of the clasp shell. Alternatively, the push button may not be in alignment with the exterior surface of the clasp shell in the locking state, but may rather be positioned inside the clasp shell or may project outwardly beyond the second opening.

The push surface of the push button may have a shape and size substantially matching a shape and size of the second opening such that in the locking state the push surface does not protrude outwardly from the clasp shell. Alternatively, the push surface does protrude outwardly from the clasp shell. The push surface of the push button may have a semi-spherical shape. When in the locking state, the push surface and an exterior surface of the clasp shell may form a sphere. The push surface may be flush with the exterior surface of the clasp shell in the locking position.

The push buttons of the invention may comprise a bottom part, which may be positioned oppositely from the second opening and/or from the push surface. The push surface may form an outer surface of a top part of the push button. The bottom part and the top part may be connected by one or more, such as two, legs. One or more of the legs may be positioned adjacent an interior surface of the clasp shell. The hole of the push button may be provided between two such legs. The bottom part and/or the legs and/or the top part may be positioned at least partly inside the spacing in both the locking and the releasing states. The bottom part may project out of a further opening in the clasp shell, the further opening being positioned oppositely from the second opening. This may be the case only in the releasing state.

The push buttons of the invention may be configured so that the push button can only be pushed in to a certain extent. This may be achieved by the spring when a maximum compression of the spring has been arrived at during the sliding movement of the push button. This may alternatively or additionally be achieved by including a button support surface attached or fixed to or in one piece with the clasp shell. This button support surface may be positioned below the top part of the push button, potentially so that a bottom surface of the top part abuts the button support surface when the push button is in the releasing state.

The push buttons of the invention may alternatively or additionally be secured to the clasp shell and/or may be configured so that they cannot be removed from the clasp shell, potentially cannot be removed without destroying the jewelry clasp. The push button may be mounted in the clasp shell so that it can slide in the spacing and potentially in the second opening as described, but so that the push button is not removable from the clasp shell.

To achieve that the push button is not removable from the clasp shell, the jewelry clasps of the invention, specifically an interior surface of the clasp shell, may comprise one or more channels and/or tracks in each of which a lateral projection or knob of the push button may slide when the push button slides between the releasing state and the locking state. The or each track may comprise one or more support elements positioned at one or both ends of the track to limit the sliding movement of the button so that the push button is prevented from being extracted from the spacing and potentially so that movement in an insertion direction of the push button is similarly limited. The one or more tracks may make it possible to allow the button to be slidable between the locking state and the releasing state and be pushed into the releasing state. The one or more knobs may each be positioned on or forming part of one or more of the above described potential legs of the push button. A U-shaped slot in the leg may define a resilient knob leg of the leg, potentially near an end of the knob leg, the knob leg carrying the knob. This slot may make the knob leg flexible so that the knob can be pushed inwardly when inserting the push button into the jewelry clasp during assembly thereof When the push button has been inserted, the knob may snap into the corresponding track. The track may be configured so that an upper track end stops the knob from being pulled further outward, thus maintaining the push button securely in the jewelry clasp.

The push buttons of the invention may comprise a stopper. The stopper may engage and lock the first end of the elongated member when the first end is positioned in the hole of the push button and the button is in the locking state. The stopper may be integral or in one part with the push button or it may be attached or fixed to a main part of the push button, specifically to the above described bottom part of the push button. In the latter case, the stopper may be inserted into in an attaching slot of a main part of the push button, specifically of the bottom part of the push button, of one or more of the above described legs of the push button, or at least partly between the bottom part and one or more of the legs. The stopper may release the first end of the elongated member when the button is in the releasing state. The stopper may be mounted at a lower or bottom end of the push button. The stopper may be a bracket positioned in the spacing and/or at the first opening and/or to extend at least partly between the first opening and the hole of the push button. The stopper may abut the spring in the locking state. The stopper may additionally or alternatively be a bar, clip, or tongue. The stopper may comprise a barb, potentially at one end thereof, the barb potentially engaging the first end of the elongated member in the locking state. The stopper may comprise or consist of metal or a metal alloy, such as silver, iron, gold, or brass, a metal alloy potentially including one or more of the latter, such as steel or a silver alloy, and/or a plastic or plastic polymer material, glass, precious stone or gemstone, wood, or any other material suitable for wearable jewelry. The stopper may be coated or plated, such as gold-plated, and/or may comprise an engraving.

The push buttons of the invention may have a maximum extent or width corresponding to an opening size of the second opening, which may allow the push button to slide in the second opening. This maximum size may be defined by the leg(s) and/or top part and or bottom part. Especially, a size of the top part and push surface thereof may correspond to an opening size of the second opening.

The push buttons of the invention may have a bottom part that substantially matches a shape and size of the second opening. When the push button during assembly is received in the second opening and is pushed to the releasing state from the locking state, it may provide audible and/or tactile feedback allowing the user to know that the clasp has been securely locked, such as a clip lock sound, which may result from the stopper engaging and locking the first end of the elongated member to the clasp.

The push button of the invention may comprise an opening in the bottom part of the push button, which is adapted to receive the stopper or a locking element. The opening may be in the form of a hole having an annular shape, or in the form of a recess, having one end in the bottom part of the push button and a second end connected to an annular opening. The stopper may be attached to the annular opening through a hinge or clop. The stopper may be pivoted around the opening such that it is allowed to rotate around the opening and thus move from the releasing state to the locking state.

The jewelry clasp may comprise a magnet exerting a magnetic force. A magnet may be defined as a material or object that produces a magnetic field. The magnet may be a permanent magnet. The first end may be of, comprise, or be a ferromagnetic material, such as iron. The magnet may be positioned in the spacing of the clasp shell, potentially on, in and/or attached to an internal surface of the clasp shell. The magnet may be positioned in a cutout in an internal surface of the clasp shell, the cut-out potentially being positioned oppositely to the first opening of the clasp shell. The magnet may at one end abut the clasp shell and/or at another end the push button and/or the spring and/or the stopper. The magnet may be configured to magnetically attract a second magnet and/or a ferromagnetic member and/or a magnetically attractable material. The magnet may alternatively be located in, or another magnet may be located in, the first end of the elongated member. The first end may be slidably received into the first opening of the clasp shell in the releasing state and/or in the locking state of the push button. The jewelry clasp may releasably secure the first end of the elongated member by the attraction between the magnet and the magnetically attractable material or by the opposite polarity between the two magnets. When the push button is in the releasing state, the first end of the elongated member may be extractable from the jewelry clasp by pulling it out of the jewelry clasp, overcoming the magnetic attraction. The magnet may have a cylindrical, annular, conical, spherical and/or parallelepipedal shape. The magnet may include several sub-magnets, e.g. a linked series of sub-magnets and/or ferrous beads. The magnet may have a width that is substantially equal to a length of the magnet. The length direction is defined as being perpendicular to the push button releasing direction. The diameter of the magnetically attractable member may be smaller than the length of the magnet. The magnet may consist of or comprise neodymium. In the releasing state, the magnet may be aligned with the hole in the push button. The hole may be a through-hole, and, potentially, the first end of the elongated member can extend through the through hole when inserted into the hole so that the first end abuts the magnet.

In an embodiment of the jewelry clasps according to the invention, the magnet is positioned inside the spacing oppositely from the first opening.

Since the magnetic forces are stronger, the closer said first end and the magnet are to each other, this configuration may allow a stronger and more secure magnetic lock of said first end to the jewelry clasp when said first end is inserted through the hole.

The magnet may be at least partly included or embedded in the clasp shell and/or may be positioned abutting, potentially be attached to, an interior surface of the clasp shell. The magnet may be provided as part of the clasp shell. The magnet may be positioned, potentially attached, in a cut-out in the interior surface of the clasp shell. Alternatively, the magnet may be provided as part of the push button so that it is slidable together with the push button.

The elongated member may be or comprise a chain, wire, string, thread, chord, or the like. The elongated member may be a snake chain. The snake chain may comprise round, wavy, and/or smooth metal plate links that are joined to form a flexible chain. The elongated member may comprise or consist of one or more of the materials mentioned above, including metal, such as silver, iron, gold, brass, or a metal alloy, potentially including one or more of these, such as steel or a silver alloy, a plastic or plastic polymer material, glass, precious stone or gemstone, wood, or any other suitable material. The elongated member may be coated or plated, such as gold-plated. The elongated member, in particular an intermediate part thereof, may be flexible and/or elastic or resilient. The elongated member may be cylindrical, and/or rigid and/or hollow. The elongated member may include or consist of interconnected or hinged joints, potentially chain joints.

The first end of the elongated member may comprise or be a shaft or a cap that is positioned adjacent to an intermediate, flexible part of the elongated member. The cap may cover an end of the latter. The first end may be or comprise a tip part, potentially forming part of the cap. The first end or cap may be fixed to or may be integral or in one piece with and/or may extend in continuation of an intermediate, flexible part of the elongated member and/or of a length direction of the elongated member. The first end or cap or, in particular, the tip part may have a conical, annular, spherical, cylindrical and/or parallelepipedal shape, which may be configured to fit into the first opening and into the hole to allow for insertion of at least part of the first end into the first opening and into, potentially through, the hole. The first end or tip part may have a truncated conical or frustoconical shape. The first end may be of or comprise a magnetically attractable material or may be or comprise a magnet. In particular, a magnet may be accommodated at least partly in a front cut-out or an open spacing of the first end, in particular a tip part thereof. A cross-sectional extent or diameter of a base and/or of the first end or tip part may be substantially equal to or somewhat smaller than a cross-sectional extent or a diameter of the first opening allowing for insertion of the first end or tip part. The first end of the elongated member may comprise a portion of reduced cross section, which portion may be formed as a bottleneck or a cut-out. The portion may be connected at one end to the tip part and/or at another end to a cap part of the first end of the elongated member. A first end of an intermediate portion, such as a chain, of the elongate member may be attached to and/or positioned in the cap part. The elongated member may have a second end, which in a piece of jewelry comprising the jewelry clasp and the elongated member may be positioned adjacent to the first end of the elongated member when the first end is inserted into the jewelry clasp.

A second end of the elongated member positioned at an opposite end of the elongated member may be in one piece or integral with the jewelry clasp or may be fixedly and/or permanently mounted in or to the jewelry clasp. The second end may include or may be a cap, which may be integral with or may be fixed or attached to a flexible intermediate part of the elongated member. The second end of the elongated member may be inserted in and/or be mounted in a third opening of the clasp shell and may potentially extend from the third opening into the spacing of the clasp shell. The third opening may be positioned oppositely from the first opening. The third opening may be an opening of a cut-out or an open spacing of the or in one piece with the clasp shell so that the second end may be inserted into the third opening and into the cut-out or spacing to be attached to the clasp shell.

The push button, the magnet and/or the spring may be at least partly positioned in and/or attached or secured in the spacing, potentially to an inner surface of the clasp shell, the inner surface potentially enclosing the spacing of the clasp shell.

The jewelry clasps of the disclosure may comprise a second stopper to engage and lock a second end of the elongated member. The jewelry clasp may include any one or more of the above configurations for locking the first end to the jewelry clasp.

In an embodiment of the above jewelry clasp, the stopper is a bracket with an inclined surface. The inclined surface in the locking position of the jewelry clasp may be positioned at an entrance to the spacing from the first opening, potentially so that insertion of said first end through the first opening will force the stopper towards the releasing position thereof, allowing insertion of said first end into said hole in the push button.

The bracket may be provided separately from other parts of the push button, especially the above-mentioned legs thereof and/or the push surface thereof and/or the above-mentioned bottom part thereof, and may be inserted into an attaching slot as described above.

The stopper or bracket may have a first end attached to a main part of the push button and a second end which may extend to cover the first opening in the locking state. The bracket may be a bent plate. The first end of the bracket may be plane to allow it to slide into the attaching slot. The second end may comprise a bend, which may be upward or towards the top part of the push button and may provide the inclined abutment surface and functionality thereof as described above and below in this disclosure. The plane first end of the bracket may include a center slot providing two legs for being received in two separate attachment slots of a main part of the push button to attach the bracket to the main part of the push button.

The stopper or bracket may prevent the first end of the elongated member and/or a tip part thereof from moving out of the jewelry clasp in the locking state thereof. This may also result in a more stable locking of the clasp.

The stopper or bracket may be mounted at one end to the push button. The bracket may automatically move the push button towards the releasing state when the first end of the elongated member is inserted into the jewelry clasp. The thickness of the insertion bracket may be 0.2-0.7 mm, or 0.3-0.6 mm or 0.5 mm.

Alternatively, the stopper may be attached or hinged at an opening or recess in the bottom part of the push button, such that it may be pivoted or rotated around it. In this case, the stopper may rotate itself and move from the releasing state to the locking state without moving the whole push button. The stopper may comprise a magnetically attractable material, which may be attracted by a magnet comprised in the first end of the elongated member. In the locked state the stopper may be attracted into locking engagement with the first end. The locking engagement may prevent the first end from being removed from the clasp. The locking engagement may be broken by bringing the stopper and/or push-button into the released state.

In an embodiment, the push button returns by means of the spring bias to the locking state if or when the first end of the elongated member is not inserted or is fully inserted in the jewelry clasp.

In an embodiment, the push button comprises a top part being positioned at least partly in the second opening in the locking state, and a bottom part positioned oppositely from top part. The bottom part and the top part may be connected by one or more legs.

In an embodiment, the jewelry clasp further comprises a button support surface fixed to the clasp shell. The button support surface may be positioned below the top part of the push button, so that a bottom surface of the top part abuts the button support surface when the push button is in the releasing position.

In another embodiment, an interior surface of the clasp shell comprises one or more tracks, in each of which channels a knob of the push button may slide when the push button slides between the releasing state and the locking state.

In an embodiment, the or each track comprises a support element positioned at an end of the track to limit the sliding movement of the push button, so that the push button is prevented from being extracted from the spacing.

In an embodiment, one said knob is positioned on one said leg of the push button, a U-shaped slot in the leg defining a resilient knob leg of the leg. Said U-shaped slot may make the knob leg flexible so that the knob can be pushed inwardly when inserting the push button into the jewelry clasp during assembly thereof According to a second aspect of the invention, a piece of jewelry, such as a bracelet or a necklace, includes a jewelry clasp according to one or more of the above embodiments; and an elongated member with a first and a second end. The first opening of the clasp shell can slidably receive the first end of the elongated member to releasably secure the first end to the second end of the elongated member. The hole of the push button can receive the first end of the elongated member when the first end is received through the first opening of the clasp shell. The stopper of the push button engages and locks the first end of the elongated member to the clasp when the first end is positioned in the hole and the push button is in the locking state, and the stopper releases the first end of the elongated member when the push button is moved from the locking state to the releasing state. Finally, the first end of the elongated member comprises a material attractable by the magnet in the spacing so that when the first end is received in the first opening of the clasp shell, the magnet exerts a magnetic force which acts to pull the first end of the elongated member into the hole of the button.

In the pieces of jewelry according to the invention, the first end of the elongated member may be perceived as a free end and/or a distal end of the elongated member. The second end may accordingly be perceived as a proximal end. The first end may be or may comprise a cap and/or a tip part as described below. The hole of the push button may receive the first end of the elongated member, when the first end is received through the first opening of the clasp shell in the releasing state and/or in the locking state of the push button.

In the pieces of jewelry according to the invention, the second end of the elongated member may be mounted, attached, connected, and/or fixed to, and/or be in one piece with the clasp shell. The second end of the elongated member may be attached to the clasp shell at a third opening of the clasp shell, which may be located oppositely from the first opening, see also above. The second end of the elongated member may comprise a tip part for being received into the third opening of the clasp shell. The third opening of the clasp shell may be formed by a ring, the ring potentially being positioned at the second side of the clasp shell oppositely from the first opening in the first side of the clasp shell. The ring may be removable from or in one piece with the clasp shell. The ring may be formed such that it receives the second end of the elongated member. The second end of the elongated member may be mounted and/or attached, e.g. by means of glue, onto and/or in the ring. The ring may be or be part of a cap enclosing the second end of the elongated member. Alternatively, the second end of the elongated member may include a cap which is inserted into the third opening and/or attached to the clasp shell. This cap may be positioned on a second end of an intermediate, potentially flexible part of the elongated member. The ring and/or the second end of the elongated member may have a shape and size substantially matching a shape and size of the third opening of the clasp shell. The clasp shell may comprise a hollow protrusion at an exterior of the clasp shell located oppositely from the first opening, the hollow protrusion in a front opening receiving the second end of the elongated member. The hollow protrusion may be surrounded and/or formed by the ring. The protrusion may have an annular, cylindrical, conical and/or parallelepipedal shape. The protrusion may be formed in one piece with or be removable from the clasp shell.

In an aspect of the invention, a piece of jewelry includes an elongated member having a first end and a second end; a jewelry clasp; a spring-biased push button; and a magnet. The jewelry clasp includes a clasp shell enclosing a spacing, the clasp shell having a first opening for slidably receiving the first end of the elongated member for releasably securing the first end to the second end of the elongated member. The spring-biased push button is slidably received in the spacing through a second opening of the clasp shell, the push button being slidable between a releasing state and a locking state so that the button can be pushed into the releasing state when a push force against a spring force is applied to the push button, the push button returning to the locking state by means of the spring force when the push force is released. The push button has a hole for receiving the first end of the elongated member when the first end is received through the first opening of the clasp shell. The push button further includes a stopper engaging and locking the first end of the elongated member when the first end is positioned in the hole and the push button is in the locking state, the stopper releasing the first end of the elongated member when the push button is in the releasing state. The magnet is positioned in the spacing or comprised in the first end of the elongated member. A material magnetically attractable by the magnet is included in that of the first end of the elongated member and the spacing which does not include the magnet, so that when the first end of the elongated member is positioned in said first opening, the magnet acts to pull said first end through the first opening and into the hole of the button.

The piece of jewelry of an aspect of the invention may be combined with any of the other pieces of jewelry as described herein.

The elongated member of the pieces of jewelry according to the invention may comprise three, four, five or six ends. One or more further elongated members may be included in the piece of jewelry. The jewelry clasp may have a fourth or a fifth or a sixth opening for receiving the respective ends.

The pieces of jewelry according to this disclosure may further comprise one, two, three, or more beads, charms, charm clips and/or other ornaments, which may include a through hole and may be strung or stringable on the elongated member.

The first opening and the hole can be said to form a female jewelry clasp, the first end of the elongated member forming a corresponding male member.

In an embodiment of the piece of jewelry according to the invention, the magnet is a first magnet positioned in the spacing, and the first end of the elongated member optionally comprises a second magnet, the magnets attracting each other when the first end of the elongated member is inserted into the first opening.

The diameter of the first magnet may be larger than the diameter of the second magnet. The second magnet may have a cylindrical, annular, conical, spherical and/or parallelepiped shape. The second magnet may be adjacent to the first end of the elongated member. The second magnet may be mounted or fixedly attached to the first end of the elongated member. See also the further possible embodiments of the second magnet described above.

In an embodiment of the piece of jewelry according to the invention, said first end comprises a tip part with a front or tip end for facing in an insertion direction when inserting said first end into the jewelry clasp through the first opening. The tip part may further comprise a rear end which may include a step or cut-out, the stopper engaging and locking said first end when the first end is positioned in the hole and the push button is in the locking state by the stopper being inserted into said step or cut-out.

This embodiment may especially be combined with the bracket configuration of the stopper as described above.

The step or cut-out may extend circumferentially about said first end.

The tip part may be provided as part of a cap comprised in or constituted by said first end, the cap potentially receiving an end, such as a chain end, of an intermediate, flexible part, such as a chain, of the elongated member.

The tip part may be according to the embodiments of the first end and the tip parts as described above, including having the shape of a truncated cone.

The tip part may in a longitudinal cross section be shaped substantially as an arrow head.

A third aspect of the invention provides a method for assembly of a jewelry clasp, the method comprising: providing a clasp shell enclosing a spacing, the clasp shell having a first opening for slidably receiving a first end of an elongated member of a piece of jewelry for releasably securing the first end to the second end of the elongated member; positioning a spring in a bottom part of a push button; positioning a push button through a second opening of the clasp shell so that the push button is slidably received in the spacing through the second opening of the clasp shell, so that the button is slidable between a releasing state and a locking state and can be pushed into the releasing state when a push force against a spring force provided by the spring is applied to the push button, the push button returning to the locking state by means of the spring force of the spring when the push force is released, wherein the button has a hole for receiving the first end of the elongated member when the first end is received through the first opening of the clasp shell, wherein the button comprises a stopper for engaging and locking the first end of the elongated member when the first end is positioned in the hole and the button is in the locking state, the stopper releasing the first end of the elongated member when the button is in the releasing state; and positioning a magnet in the spacing, the magnet exerting a magnetic force which, when the first end of the elongated member includes a material magnetically attractable by the magnet, pulls said first end of the elongated member through the first opening and into the hole of the push button when said first end is positioned in said first opening.

The method steps may be carried out subsequently, or in any other suitable sequence, in particular the sequence 1)-2)-4)-3).

The push button, the magnet and/or the spring may be attached in or secured in the spacing, potentially to an inner surface of the clasp shell, the inner surface potentially enclosing the spacing of the clasp shell.

Another aspect of the invention involves a method for opening a piece of jewelry according to one of the embodiments of the invention, comprising: pushing the push button against the spring force by exerting a push force on a push surface of the button, whereby the stopper releases the first end of the elongated member; and removing the first end of the elongated member by pulling the first end of the elongated member out of the hole of the button and out of the first opening of the clasp shell.

Another aspect of the invention involves a method for closing a piece of jewelry according to one of the embodiments of the invention, comprising: inserting the first end of the elongated member into the first opening of the clasp shell and into the hole of the push button, so that during this insertion the first end engages the stopper, whereby the insertion of the first end pushes the stopper from the locking state into the releasing state to allow said first end to be inserted into the hole of the push button.

As described above, the user may not have to press the push button to insert the first end of the elongated member into the clasp and close the piece of jewelry. This allows for an easier closing of the piece of jewelry, especially when this is a bracelet since the user will only be able to use one hand to close the bracelet. Alternatively, the user may need to press the push button to allow the first end of the elongated member to be inserted into the hole and engage with the second end of the elongated member. The magnetic force pulling the first end of the elongated member into the hole may have the advantage that a weaker force is required to be applied to close the piece of jewelry.

The first end may, thus, be received into the first opening of the clasp shell and/or into the hole of the push button in the releasing state and/or in the locking state of the push button.

Further embodiments and advantages of the jewelry clasps, pieces of jewelry, and methods according to this disclosure are disclosed in the subsequent detailed description and drawings.

BRIEF DESCRIPTION OF THE DRAWINGS

In the following, an embodiment of a jewelry clasp according to the invention will be described with reference to the enclosed drawings, in which.

DETAILED DESCRIPTION

Figure 1:
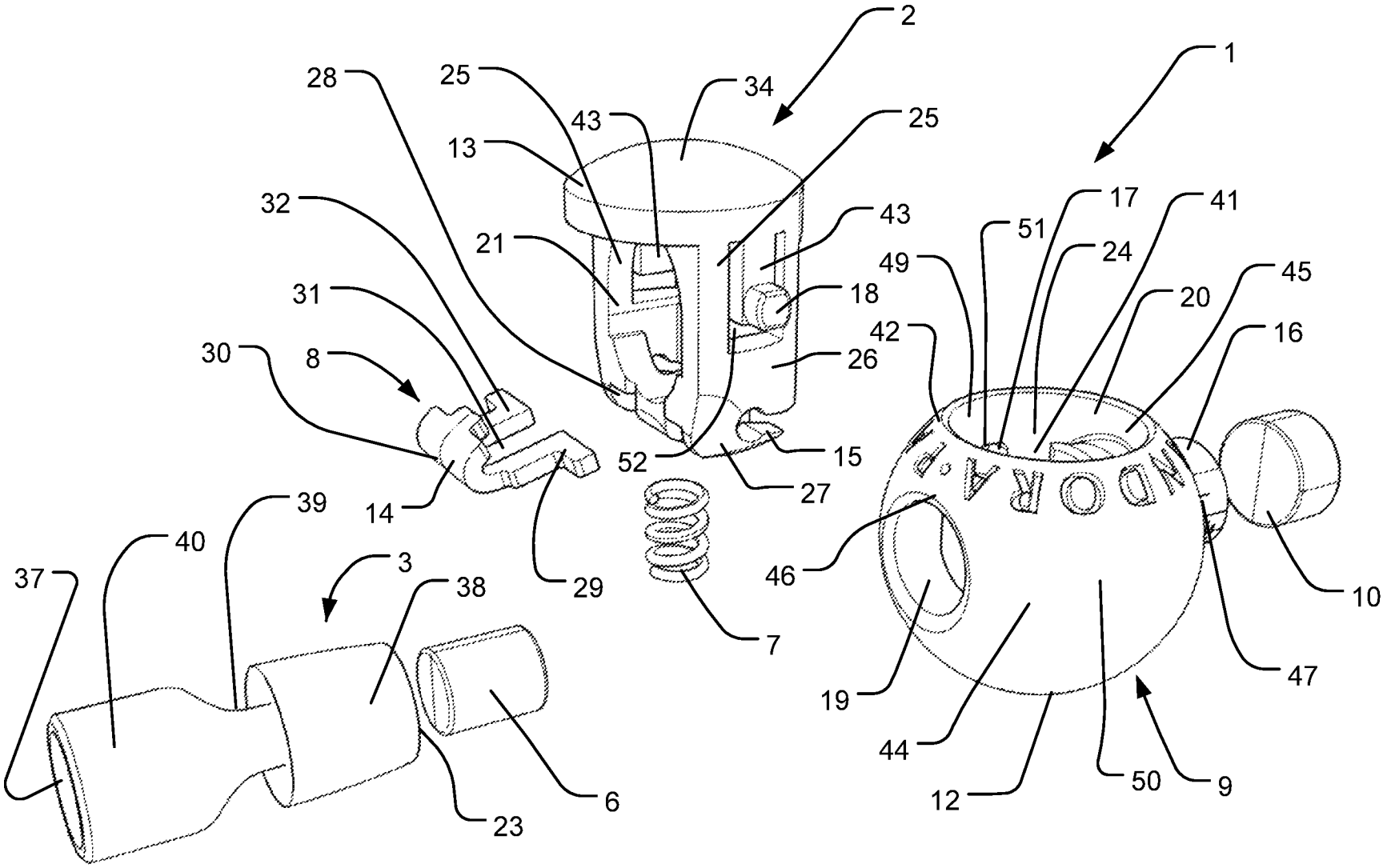
FIG. 1 is an exploded view of an embodiment of a jewelry clasp and a first end or cap of a piece of jewelry according to an embodiment of the pieces of jewelry of this disclosure.
Figure 2:
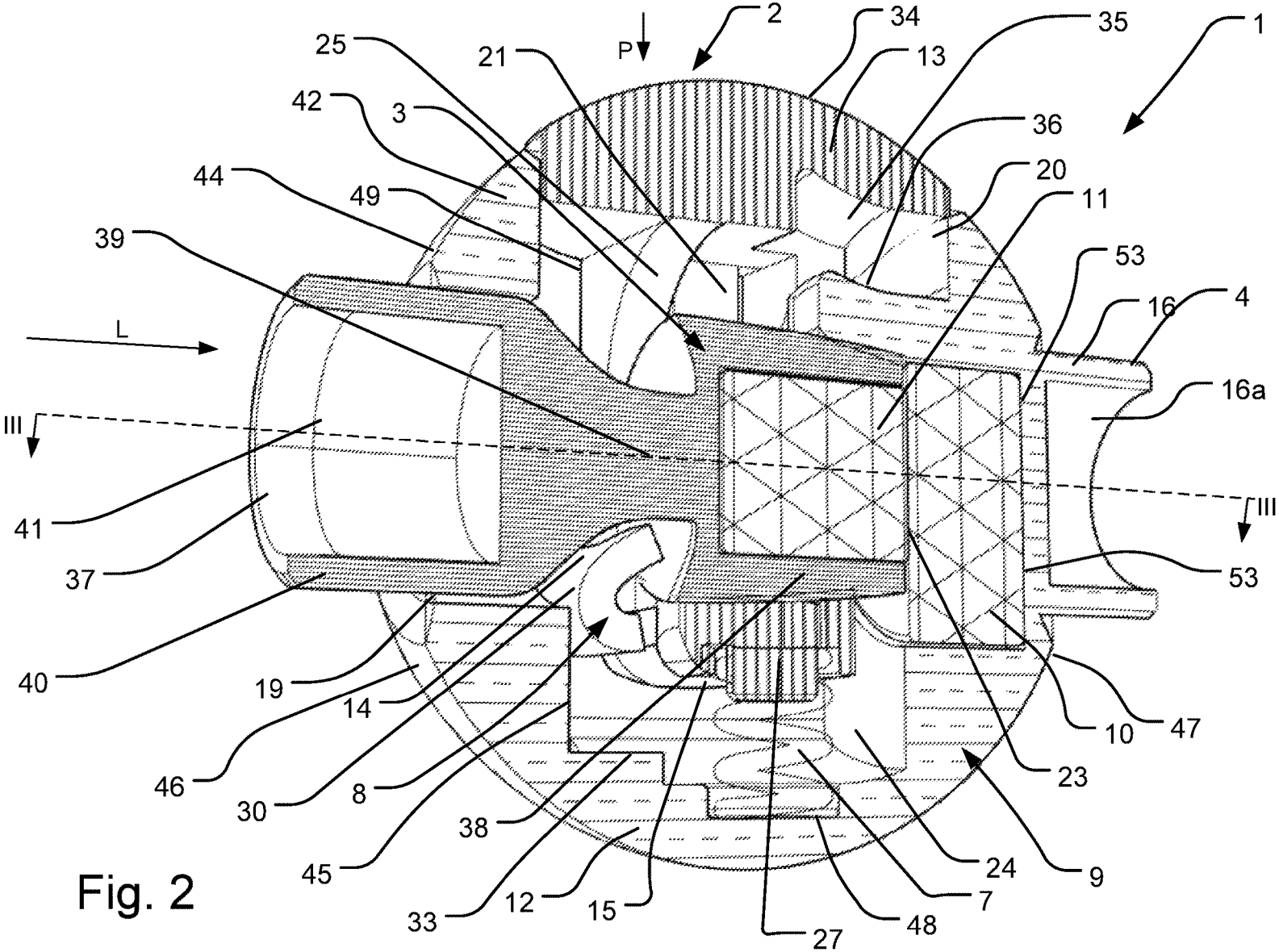
FIG. 2 is a perspective cross-sectional view taken along the line II-II of FIG. 3 of the embodiment of FIG. 1 in an assembled configuration shown in a locking state of the jewelry clasp.
Figure 3:
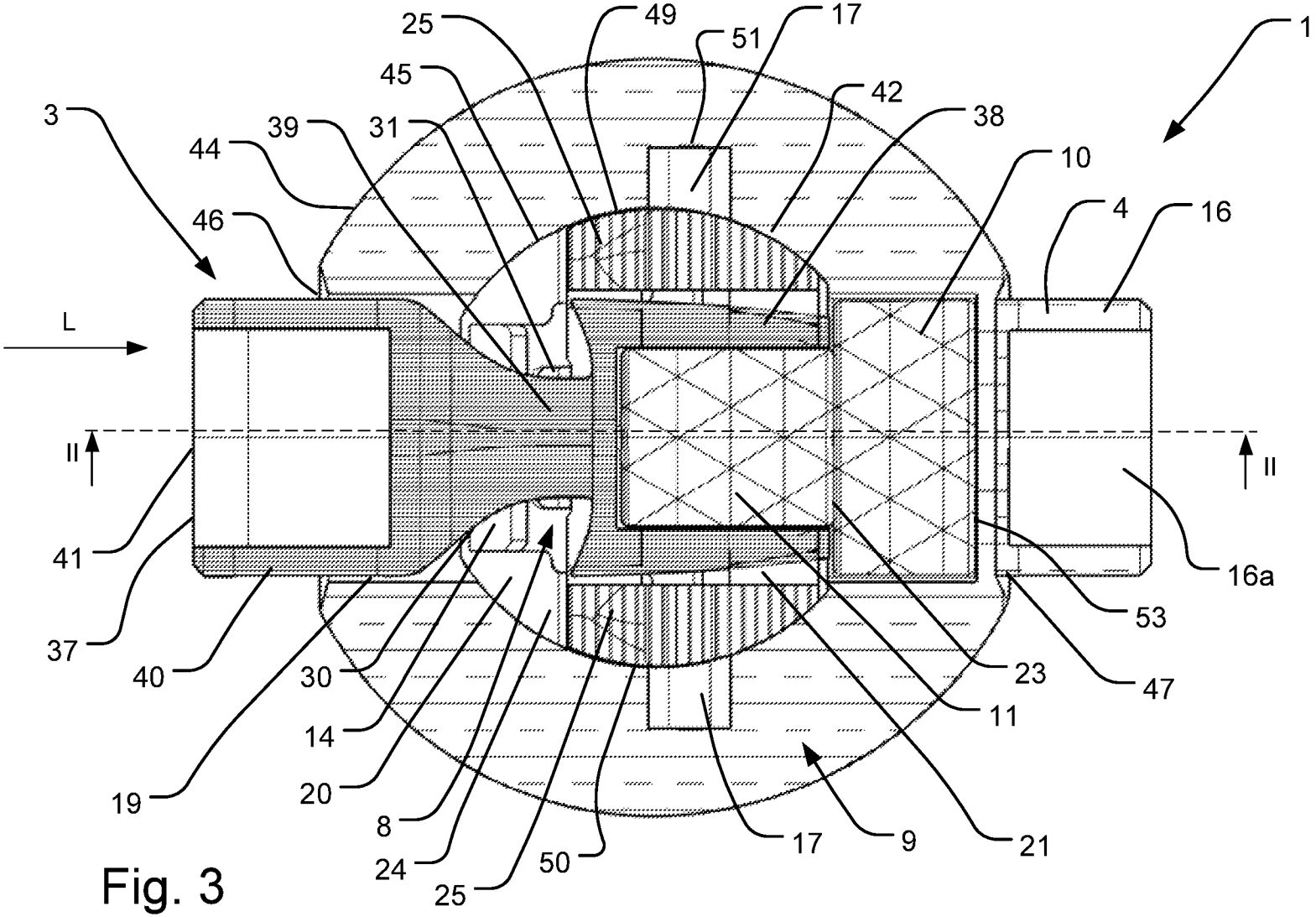
FIG. 3 is a cross-sectional top view taken along the line of FIG. 2.
Figure 4:
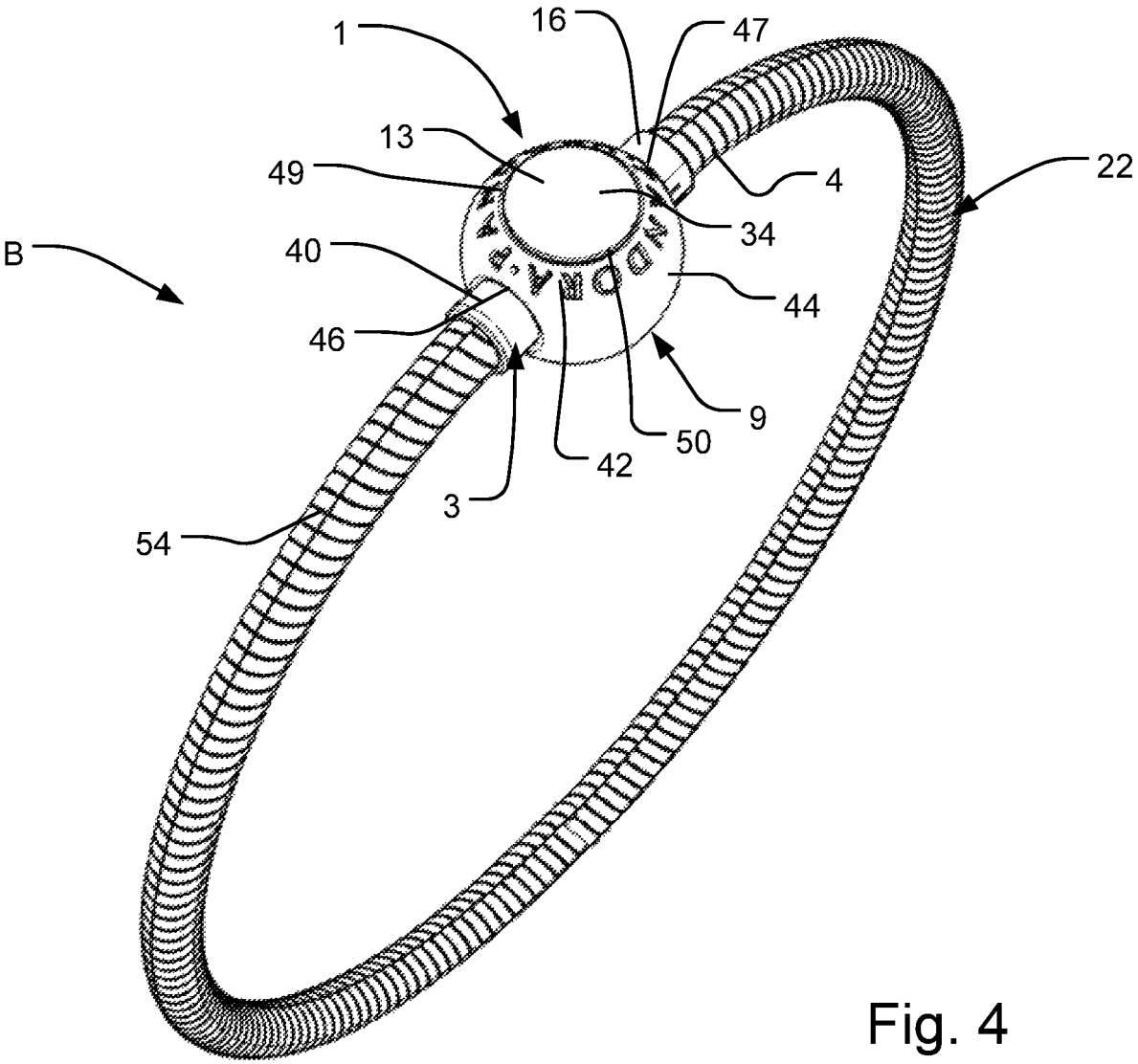
FIG. 4 is a perspective view of a bracelet according to an embodiment of the pieces of this disclosure, including the assembled jewelry clasp of FIG. 2, wherein the bracelet is shown in a closed state.
Figure 5:
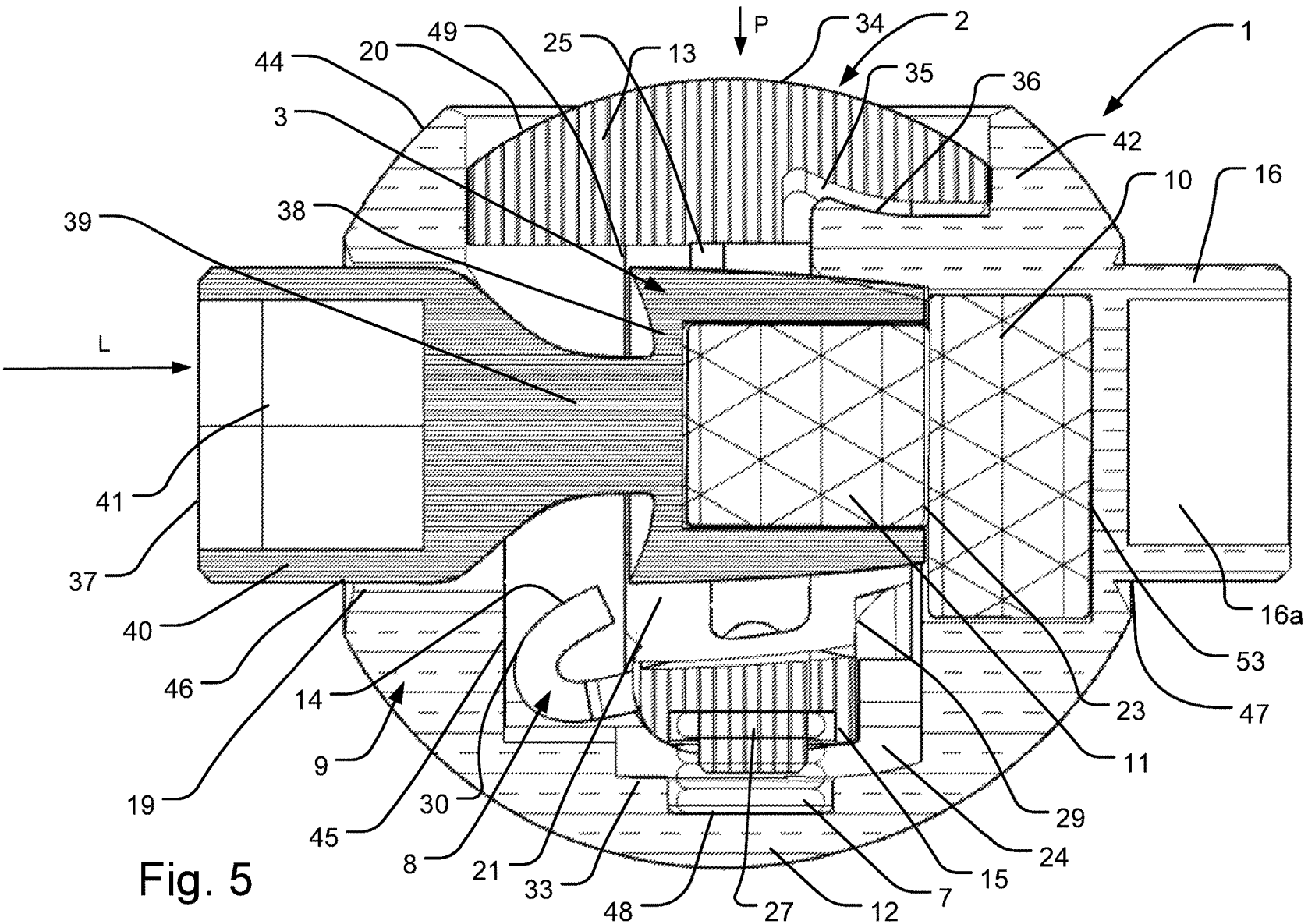
FIG. 5 is a cross-sectional side view corresponding to that of FIG. 3 of the jewelry clasp of FIGS. 2 and 3, showing a releasing state of the jewelry clasp.
Figure 6:
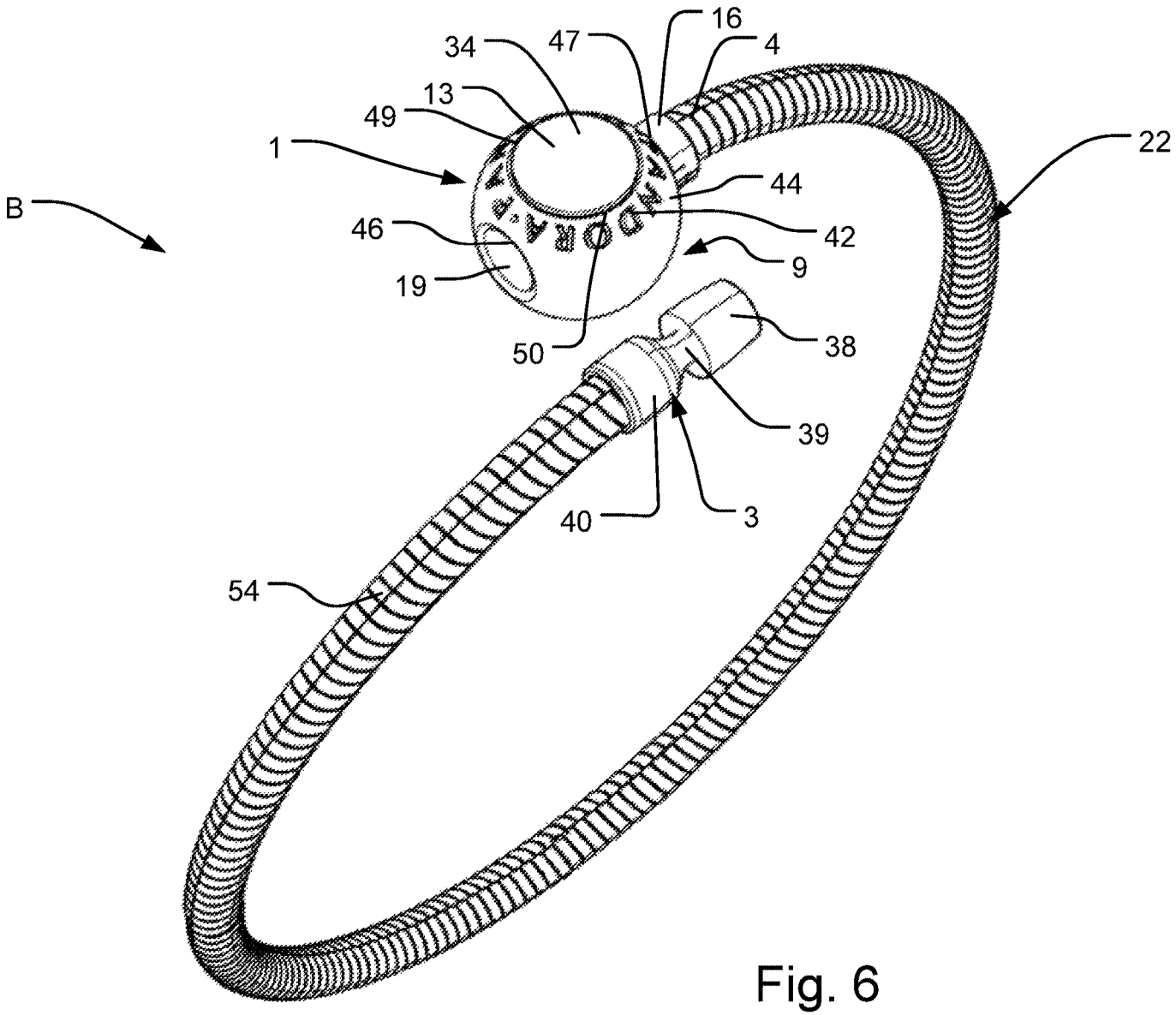
FIG. 6 is a perspective view of the bracelet of FIG. 4, wherein the bracelet is shown in a released state.
Figure 7:
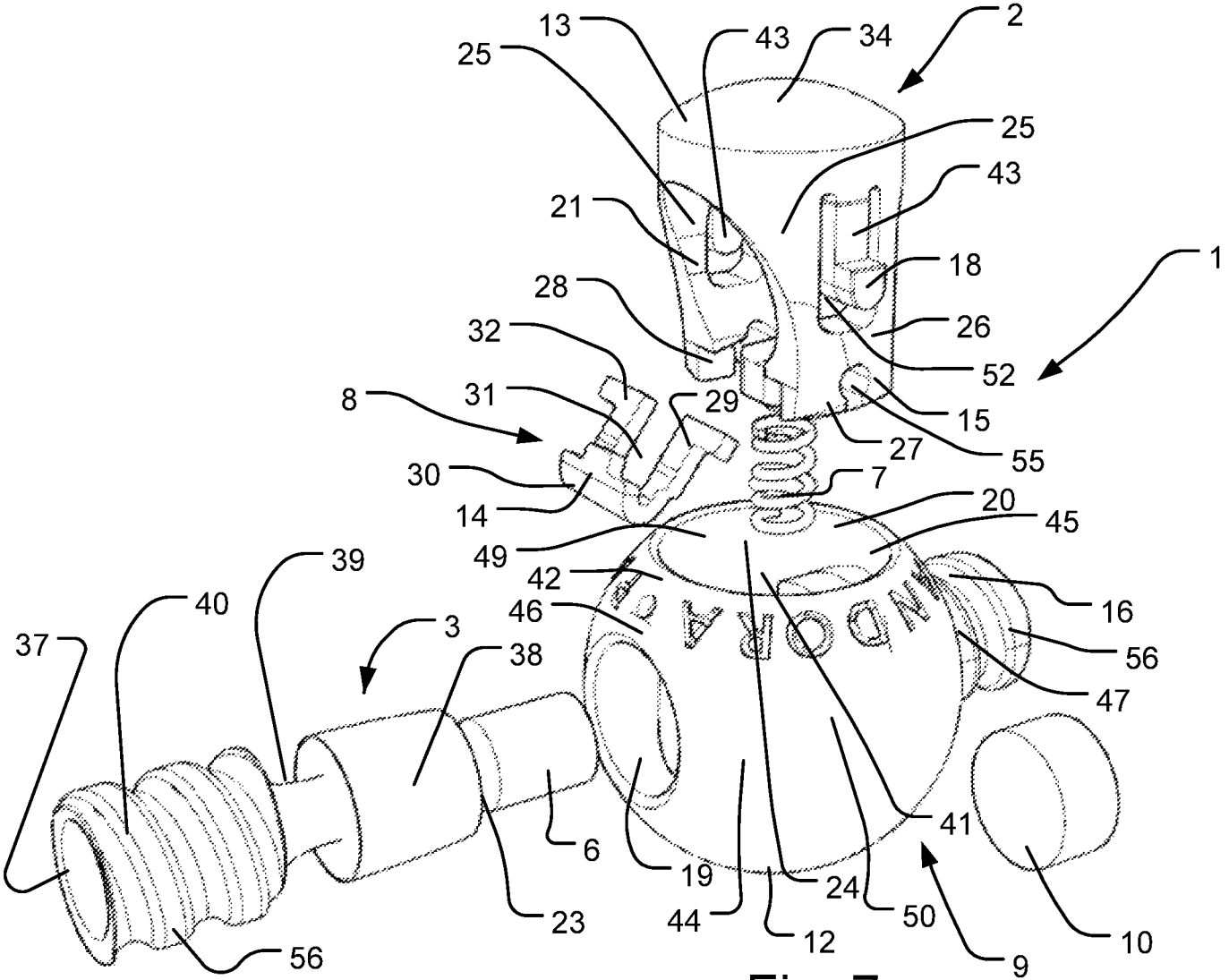
FIG. 7 is an exploded view of another embodiment of a jewelry clasp and a first end or cap of a piece of jewelry according to an embodiment of the pieces of jewelry of this disclosure.
Figure 8:
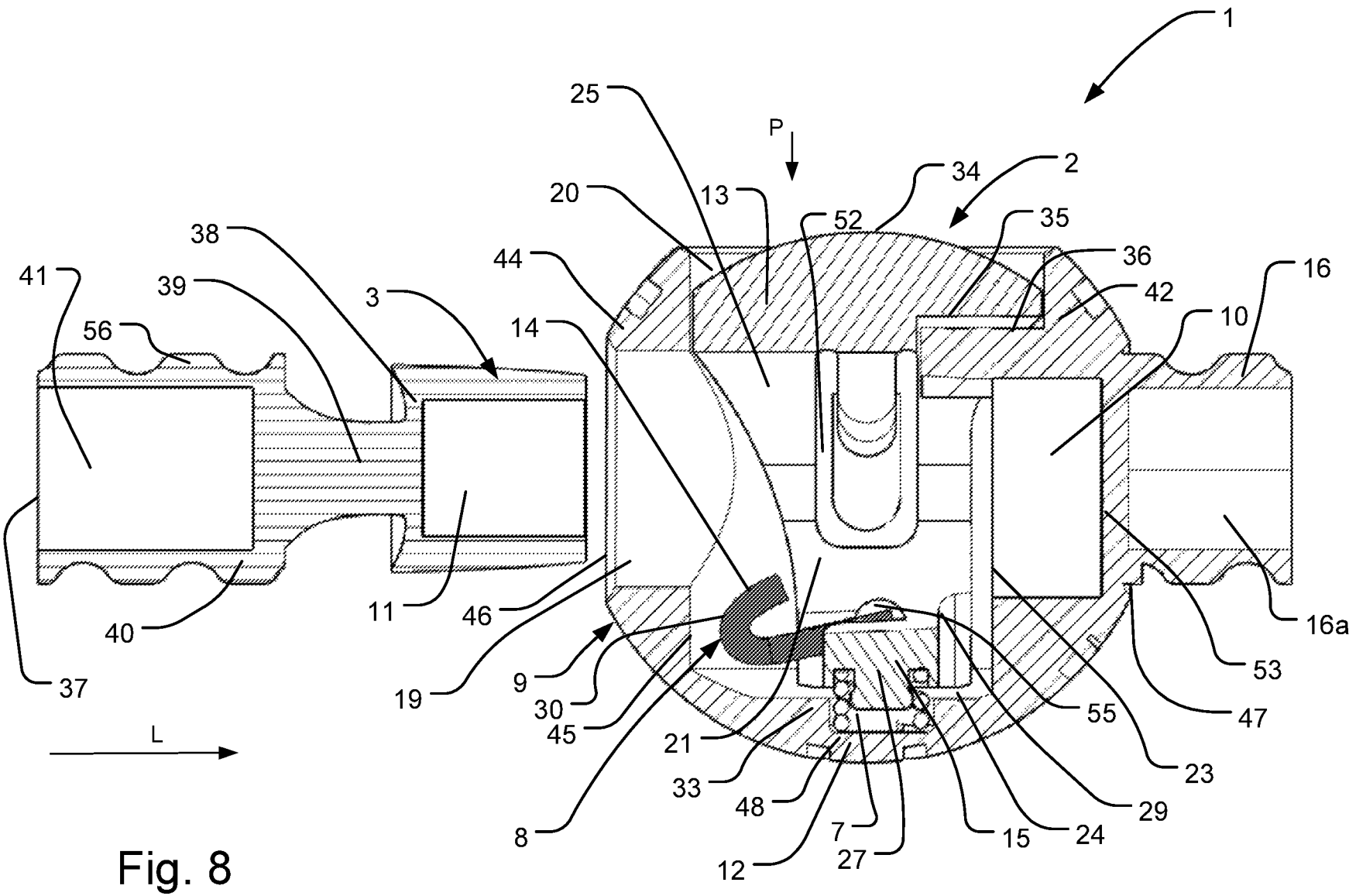
FIG. 8 is a cross-sectional side view corresponding to that of FIG. 7 of the jewelry clasp, showing a releasing state of the jewelry clasp.

FIGS. 1 to 3 and FIG. 5 show a jewelry clasp 1 according to an embodiment of the jewelry clasps according to the invention, and a first end in the form of a cap 3 of an elongated member 22. FIGS. 4 and 6 show an embodiment of a piece of jewelry, specifically a bracelet B, including the jewelry clasp 1 shown in FIGS. 1 to 3 and 5. FIGS. 2, 3, and 4 show the jewelry clasp 1 in a locking position, while the jewelry clasp 1 is shown in a releasing position in FIGS. 5 and 6. The bracelet B is shown in a locked position in FIG. 4 and in an unlocked or released position in FIG. 6. FIGS. 7 and 8 show another embodiment of a piece of jewelry, a bracelet B, including an embodiment of the jewelry clasp 1.

The jewelry clasp 1 is intended for securing or attaching the cap 3 of the bracelet B to a second end 4 of the elongated member 22, as shown in FIG. 4. Hereby, the bracelet B can be attached to a user's wrist and be securely worn by the user. When the cap 3 is released from the clasp 1, one or more not shown beads, charms, bangles, or other stringable ornaments, which include a through hole for stringing, may be strung onto the elongated member 22 from the cap 3. A charm clip (not shown) may similarly be clipped onto the bracelet B in both the locked and unlocked states of the bracelet.

The jewelry clasp 1 comprises a one-piece, spherical clasp shell 9 enclosing and defining an interior spacing 24, see e.g. FIGS. 1 and 2. The shell 9 has a first opening 19 for slidably receiving the cap 3 of the elongated member 22 and for releasably securing the cap 3 to the clasp 1 and, thus, to the second end 4 of the elongated member, whereby the bracelet B is closed as shown in FIG. 4. FIG. 1 shows the clasp 1 in an unassembled position. In the assembled clasp 1 as shown in the remaining figures, a spring-biased push button 2 is slidably received in the spacing 24 through a second opening 20 of the clasp shell 9. The button 2 is slidable between the releasing state (FIG. 5) and the locking state (FIGS. 2 and 3). The button 2 can be pushed into the releasing state when a push force against a spring force is applied to the button 2. The button 2 is returning to the locking state by means of the spring force when the push force is released, see also further below.

The button 2 has a hole 21 for receiving the cap 3 of the elongated member. The cap 3 in the releasing state of the push button 2 and clasp 1 is received through the first opening 19 of the clasp shell 9. As best seen in FIG. 2, the button 2 further comprises a stopper 8 for engaging and locking the cap 3 of the elongated member 22 when the cap 3 is positioned in the hole 21 and the button 2 is in the locking state. As best seen in FIG. 5, the stopper 8 releases the cap 3 of the elongated member when the button 2 is in the releasing state, so that the cap 3 can be pulled out of the clasp 1 as shown in FIG. 6.

As best seen in FIG. 2, the clasp 1 further comprises a circular cylindrical, first magnet 10 positioned in the spacing 24 opposite to the first opening 19 of the clasp shell 9 into a corresponding circular cylindrical cut-out in the interior surface 45 of the clasp shell 9. The cap 3 of the elongated member comprises a second magnet 11. The second magnet 11 is similarly of a circular cylindrical shape and is positioned in a circular cylindrical cut-out in a front of the cap 3. The first magnet 10 has a magnetic polarity at a front end facing the first opening 19. The second magnet 11 has the opposite magnetic polarity at the front end of the cap 3. When inserting the cap 3 through the first opening 19, the second magnet 11 and thus the cap 3 of the elongated member 22 are pulled through the first opening 19 and into the hole 21 of the button 2, until the front end of the cap 3 and thus a front end of the second magnet 11 abut the front end of the first magnet 10 when the cap 3 is positioned in the first opening 19 and the hole 21. When releasing a push on the push button 2, the push button 2 will then return from the releasing state shown in FIG. 5 to the locking state shown in FIGS. 2 and 3, the stopper 8 engaging and locking the cap 3.

As shown in FIGS. 2, 3, and 5, a length direction L is defined as a direction in which the cap 3 of the elongated member 22 moves or slides during insertion into the jewelry clasp 1. When the cap 3 is extracted from the clasp 1, the cap 3 moves in a direction opposite to the direction L. As shown in FIGS. 2 and 5, a pushing direction P of a push force on the push button 2 acting to release the cap 3 of the elongated member from the jewelry clasp 1 is a direction at an angle perpendicular to the length direction L. The clasp shell 9 forms a housing for a spring 7, the push button 2 including the stopper 8, the first magnet 10, and (when the cap 3 is inserted into the clasp 1) a front part of the cap 3. The clasp shell 9 includes a circumferentially extending wall with a spherical exterior surface. The shape of the clasp shell 9 and the assembled clasp 1 is generally spherical. The clasp shell 9 is a one-piece element. The clasp shell 9 further comprises annular wall sections 41. The clasp shell 9 comprises an exterior surface 44 facing the environment and an interior surface 45 facing the internal parts of the clasp, including the button 2.

The clasp shell 9 further comprises an upper part 42, a lower part 12 positioned oppositely from the upper part 42, a first side 46, and a second side 47, each of the first and second sides connecting the upper and lower parts. The first 46 and the second side 47 are positioned oppositely from each other. A top part 13 of the push button is positioned near the upper part 42 of the clasp shell 9; a bottom part 27 of the push button near the lower part 12 of the clasp shell 9. The clasp shell 9 comprises the first opening 19 and the second opening 20. The first opening 19 is positioned at the first side 46 of the clasp shell 9. The first end of the elongated member is received in the first opening 19. The second opening 20 is positioned at the upper part 42 of the clasp shell 9. The first opening 19 and second opening 20 are located at positions at a right angle to each other, the angle being measured from a center of the clasp shell 19. The first 19 and second opening 20 extend into and provide access to the spacing 24. The second opening 20 has a diameter that is equal to two times the diameter of the first opening 19.

The interior surface is beveled and includes a stepped portion 33 at the lower part 12 of the clasp shell 9. The clasp shell 9 encloses the spacing 24. The spacing 24 extends from a top of the clasp and from an upper part 42 of the clasp shell to a bottom of the clasp or the lower part 12 of the clasp shell 9. The clasp shell 9 encloses the spring 7, the push button 2 including the stopper 8, and the magnet 10.

The clasp shell 9 also comprises a third opening positioned at the second side 47 of the clasp shell 9. The third opening is positioned oppositely from the first opening 19 at the first side 46 of the clasp shell 9. The third opening is provided as a cut-out or spacing **16*a* in a ring 16 forming part of the clasp shell 9, see further below. A diameter of the third opening or cut-out 16*a* is of equal size to the diameter of the first opening 19. All the first, second, and third openings 19, 20, 16*a*** are circular in a cross-section.

The second end 4 is fixedly mounted to the jewelry clasp shell 9. More specifically, the second end 4 of the elongated member 22 is mounted in the cut-out **16*a*. The ring 16 is an open-ended hollow protrusion positioned at the second side 47 of the clasp shell 9 oppositely from the first side 46 of the clasp shell 9 and from the first opening 19. The ring 16 is integrated in and/or one piece with the clasp shell 9**.

During assembly of the clasp 1, the spring-biased push button 2 is received into the spacing 24 through the second opening 20 of the clasp shell 9 before the push button 2 is received in the spacing 24. The spring force acting on the push button 2 in the assembled state of the clasp 1 arises from the helical coil spring 7. The spring 7 is mounted at the bottom part 27 of the button 2 and abuts an interior surface 48 of the lower part 12 of the clasp shell 9. The spring 7 biases the push button 2 towards the locking state. The spring force is applied to act against the push direction P of the push button 2.

The push button 2 comprises two separate cylinder cell sections formed as legs 25 defining the hole 21 between them for receiving the cap 3 of the elongated member 22. The hole 21 is positioned below the top part 13 of the push button. The push button includes a push surface 34 positioned on the top part 13 of the push button 2. As best seen in FIG. 2, the push surface 34 is in the locking state positioned in alignment with an exterior surface of the clasp shell 9. The push surface 34 is a rounded surface that in the locking state continues the spherical shape of the exterior surface 44 of the clasp shell 9. The top part 13 of the push button 2 has a shape and size substantially matching a shape and size of the second opening 20. Furthermore, in the locking position the push surface 34 is flush with the exterior surface 44 of the clasp shell 9.

The push button 2 further comprises a bottom part 27, which is positioned oppositely from the second opening 20 and from the push surface 34. The bottom part 27 and the top part 13 are connected by the two legs 25. The two legs 25 are positioned adjacent an interior surface of the clasp shell 9 at third 49 and fourth 50 sides of the clasp shell 9. The hole 21 of the push button is defined at a top by the top part 13, at a bottom by the bottom part 27, and at two sides by the respective two legs 25. The bottom part 27 and the legs 25 are positioned inside the spacing 24 in both the locking and the releasing states. The top part 13 and the push surface 34 project from the clasp shell 9 in the locking state.

The push button 2 is configured so that it can only be pushed into the spacing 24 to a limited extent. This is achieved by a button support surface 36 forming part of the clasp shell 9. The button support surface 36 is positioned below the top part 13 of the push button 2, so that a lower surface 35 of the top part 13 abuts the button support surface 36 when the push button 2 is pushed to the releasing position. Alternatively, this may be achieved by the spring 7 so that when a maximum compression of the spring has been arrived at during the sliding movement of the push button 2, the movement of the push button 2 in the direction P is limited by the spring 7.

As seen best in FIGS. 3 and 1, an interior surface of the clasp shell 9 at the third 49 and fourth 50 sides thereof comprises two opposed tracks 17 in each of which a knob 18 of the push button 2 slides when the push button 2 slides between the releasing state and the locking state. Each track 17 comprises an upper track end 51 to limit the sliding movement of the push button 2 so that the push button 2 is prevented from being extracted from the spacing 24, the respective knob 18 in the locking state abutting the upper track end 51. The knobs 18 form part of each respective leg 25. A U-shaped slot 52 in each leg 25 defines a resilient tongue or knob leg 43 of each leg, the outwardly projecting knob 18 being located near a free end of the knob leg 43. The knob leg 43 carries the knob 18. Each knob leg 43 is flexible and resilient so that the associated knob 18 can be pushed inwardly when inserting the push button 2 into the jewelry clasp 1 during assembly of the jewelry clasp 1. When the push button 2 has been inserted, the knob 18 snaps into the corresponding track 17, and the push button 2 is hereby not removable from the clasp shell 9. The tracks 17 are each configured so that the upper track end 51 stops the knob 18 from being pulled further outward, thus maintaining the push button 2 securely in the clasp shell 9.

The push button 2 comprises the stopper 8. The stopper 8 engages and locks the cap 3 of the elongated member 22 when the cap 3 is positioned in the hole 21 of the push button and the button is in the locking state shown in FIGS. 2 and 3. During assembly of the jewelry clasp 1, the stopper 8 is attached to the bottom part 27 of the push button 2 by insertion of the stopper 8 into an attachment slot 28 of the bottom part of the push button 2 before the assembled push button 2 is inserted through the second opening 20 to be received in the spacing 24. In the assembled jewelry clasp 1, the stopper 8 releases the cap 3 of the elongated member when the button 2 is in the releasing state shown in FIG. 5. The stopper 8 is a bracket that comprises a barb 30 engaging the cap 3 in the locking state. The barb 30 includes an inclined surface 14. In the locking position of the jewelry clasp 1, the inclined surface 14 is positioned at an entrance to the spacing 24 from the first opening 19, so that insertion of said cap 3 through the first opening 19 forces the push button 2 towards the releasing position thereof, allowing insertion of said cap 3 into and through said hole 21 in the push button 2. The stopper 8 is provided separately from other parts of the push button 2, especially the legs 25 and the push surface 34 and the bottom part 27, and is during assembly of the push button inserted into the attachment slot 28 as described above. The stopper 8 has an end 29 positioned oppositely from the barb 30. The end 29 is attached to a main part 26 of the push button 2. The main part 26 comprises the top part 13, bottom part 27, and the legs 25 of the push button 2. The main part 26 is formed in one piece, especially molded in one piece. The end 29 is plane to allow it to slide into the attachment slot 28, which is provided in the bottom part 27 of the push button 2. The barb 30 is formed by a bend at an opposite end of the stopper 8 and provides the inclined abutment surface and functionality as described above. The plane first end 29 of the stopper 8 includes a center slot 31 providing two legs 32 received in two separate parts of the attachment slot 28. The stopper 8 prevents the cap 3 of the elongated member 22 and a tip part 38 thereof from moving out of the jewelry clasp 1 in the locking state.

The magnet 10 is positioned inside the spacing 24 oppositely from the first opening 19. The hole 21 is a through-hole, whereby the cap 3 is allowed to abut the magnet 10 when inserted through the hole 21. The magnet 10 is positioned in a cutout in the interior surface 45 of the clasp shell 9 opposite from the first opening 19 of the clasp shell 9. The magnet 10 abuts the clasp shell 9 at a back end of the magnet 10. The magnet 10 is configured to magnetically attract the second magnet 11. The second magnet 11 is located in the cap 3 of the elongated member. During closing of the bracelet B, the cap 3 is guided to be slidably received into the first opening 19 of the clasp shell 9. The push button 2 returns by means of the bias from the spring 7 to the locking state when the cap 3 of the elongated member is not inserted or is fully inserted in the jewelry clasp 1, and when the push button 2 is not pushed. The jewelry clasp 1 releasably secures the cap 3 of the elongated member 22 by the opposite polarity of the two magnets 10, 11. When the push button 2 is in the releasing state as shown in FIG. 5, the cap 3 is extractable from the jewelry clasp 1 by pulling it out of the jewelry clasp 1, overcoming the magnetic attraction between the two magnets 10, 11. In the releasing state, the magnet 10 is aligned with the hole 21 in the push button 2. The cap 3 of the elongated member 22 extends through the hole 21 when inserted into the hole 21 so that the cap 3 abuts the magnet 10.

The elongated member 22 comprises a flexible, intermediate portion in the form of a flexible snake chain 54.

The cap 3 of the elongated member 22 is perceived as a free, distal end of the elongated member 22. The second end 4 is perceived as a proximal end. The cap 3 comprises the tip part 38. The second end 4 is a free end of the snake chain 54. The tip part 38 has a frustoconical shape, which is configured to fit into the first opening 19 and into the hole 21. The cap 3 comprises a magnet 11; in particular, the magnet 11 is accommodated in the tip part 38. The second end 4 is inserted into the ring 16 as described above and shown in FIGS. 4 and 6.

In the embodiment of the drawings, the ring 16 is part of the jewelry clasp 1 and is in one piece with the clasp shell 9. In other embodiments, the ring 16 can generally be provided as part of a cap of the second end 4, such a cap of the second end 4 being similar or identical to the cap 3 and being inserted into the clasp shell 9 to be held by the jewelry clasp 1. In such embodiments, the cap of the second end 4 may be configured to be releasable from the jewelry clasp 1 in a manner similar or identical to the cap 3; in such embodiments, a cap of the second end 4 may instead include the first magnet 10 so that the two ends 3, 4 are attracted to each other when both are inserted into the jewelry clasp 1.

The magnet 10 and the spring 7 are positioned in the spacing 24 and abutting or attached to the interior surface 45 of the clasp shell 9, the interior surface 45 enclosing the spacing 24 of the clasp shell 9.

As illustrated in FIG. 4, in the bracelet B including the jewelry clasp 1 and the elongated member 22, the cap 3 of the elongated member 22 is enclosed in the clasp shell 9 in a closed position of the bracelet B. The bracelet B comprises the jewelry clasp 1 and the elongated member 22 with the cap 3 and the second end 4. The first opening 19 of the clasp shell 9 can slidably receive the cap 3 of the elongated member 22 to releasably secure the cap 3 to the jewelry clasp 1 and to second end 4 of the elongated member 22. The hole 21 of the push button 2 can receive the cap 3 of the elongated member 22 when the cap 3 in the releasing state of the push button 2 shown in FIG. 5 is received through the first opening 19 of the clasp shell 9. The stopper 8 of the push button 2 then engages and locks the cap 3 to the jewelry clasp 1 when the cap 3 is positioned in the hole 21 and the push button 2 is in the locking state, and the stopper 8 releases the cap 3 of the elongated member 22 when the push button 2 by a pushing force exerted on the push surface 34 is moved from the locking state to the releasing state.

The cap 3 comprises at a front end the tip part 38 with a front or tip end facing in the insertion direction L when inserting the cap 3 into the jewelry clasp 1 through the first opening 19. The cap 3 also comprises at a rear end a cap part 40 which includes an open spacing or cutout 37 open at a rear end of the cap 3 and in which a first end of the snake chain 54 is inserted, as shown in FIGS. 4 and 6. The cap 3 further comprises a portion 39 of reduced cross section, more specifically of reduced diameter, formed as a bottleneck positioned between the cap part 40 and the tip part 38. The diameter of the portion 39 is about half the diameter of the cap part 40 and the diameter of the tip part 38. The portion 39 is connected at one end to the tip part 38 and at the other end to the cap part 40. The cap 3 is in one piece, except for the magnet 11. A first end of the snake chain 54 is received in the cut-out 37 and attached to the cap 3 in a manner identical to the attachment of the second end 4 in the ring 16, see FIGS. 4 and 6. The stopper 8 engages and locks the cap 3 when the cap 3 is positioned in the hole 21, and the push button 2 is in the locking state, by the stopper 8 being inserted into the cut-out 37. The cut-out 37 extends circumferentially about the cap 3. The cap 3 is receiving the end, of the intermediate, flexible part of the elongated member.

As seen in FIG. 7, another embodiment of the jewelry clasp 1 is shown, wherein the push button 2 further comprises an opening 55 in the bottom part 27 of the push button 2, which is adapted to receive the stopper 8. The opening 27 has an annular shape. The stopper 8 is attached through a hinge (not shown) to the opening 55 and rotates around the opening 55 being movable from the releasing state to the locking state. In the embodiment shown in FIGS. 7 and 8, the cap part 40 and the ring 16 comprise a ribbed casing, in the form of a tread. The remaining features are essentially the same with the ones in the embodiments previously presented and will not be described hereafter.

FIG. 8 shows the jewelry clasp 1 in the releasing state, where the push force P is applied to the surface 34. The stopper 8 has thus released the cap 3 and the first end of the elongated member is pulled out of the hole 21 and out of the clasp shell 9 through the first opening 19. The stopper 8 has thus moved from the locking state to the releasing state. In this embodiment, the stopper 8 comprises a magnetically attractable material, so when the cap 3 is inserted back to the clasp shell 9 through the first opening 19, the stopper 8 is instantly magnetically attracted by the magnet 11 and brought towards the locking state, until the cap 3 forces the stopper 2 towards the releasing position, allowing insertion of the first end into the hole 21 in the push button.

The jewelry clasp 1 may be assembled according to the following sequence of method steps:

(1) the clasp shell 9 of FIG. 1 is manufactured, e.g. by molding;

(2) the push button main part 26 of FIG. 1 is manufactured, e.g. by molding;

(3) the magnet 10 is positioned to be attached to the clasp shell 9 as previously described;

(4) the stopper 8 is inserted into the push button main part 26 as previously described so that the push button is fully assembled;

(5) the coil spring 7 is attached to a projection 15 of the bottom part 27 of the push button main part 26, more specifically, an upper coil of the spring 7 is allowed to circumscribe the projection 15, see e.g. FIG. 2; and (6) the assembled push button 2 with the spring 7 attached to the bottom part 27 is inserted through the second opening 20 of the clasp shell 9 so that the push button 2 is slidably received in the spacing 24, the push button 2 being slidable between the releasing state shown in FIG. 5 and the locking state shown in FIGS. 2 and 3.

The bracelet B including the jewelry clasp 1 may then be assembled by attaching the second end 4 of the elongated member 22 to the clasp shell 9 as previously described.

If the cap 3 of the bracelet B is inserted into and locked to the jewelry clasp 1 as shown in FIGS. 2, 3, and 4, the bracelet B can be opened by the following sequence of steps:

(1) a push force is exerted on the push surface 34 of the button, e.g. by means of a hand or finger, whereby the stopper 8 releases the cap 3; and (2) the cap is removed from the jewelry clasp 1 by pulling the cap 3 out of the hole 21 of the push button 2 and out of the first opening 19 of the clasp shell 9.

If the cap 3 of the bracelet B is not inserted into the jewelry clasp 1 as shown in FIGS. 4 and 6, the bracelet B can be closed by inserting the cap 3 into the first opening 19 of the clasp shell 9 and into the hole 21 of the push button 2, so that during this insertion the tip part 38 of the cap 3 engages the stopper 8, whereby the insertion of the cap 3 pushes the stopper 8 from the locking state shown in FIGS. 2 and 3 into the releasing state shown in FIG. 5 to allow the cap 3 to be inserted into the hole 21.

As explained, the user does not need to press the push button 2 to insert the cap 3 into the jewelry clasp 1 and close the bracelet B which may allow the user to use only a single hand to close the bracelet B.

The disclosure is not limited to the embodiments shown and described in the above, and various modifications and combinations may be carried out.

LIST OF REFERENCE NUMERALS

1 Jewelry clasp
2 Push button
3 Cap
4 Second end of elongated member 22
7 Spring
8 Stopper
9 Clasp shell
10 First magnet
11 Second magnet
12 Lower part of clasp shell 9
13 Top part of push button 2
14 Inclined surface of stopper 8
15 Projection of push button 2
16 Ring
16*a* Cut-out in ring 16
17 Track
18 Knob
19 First opening of clasp shell 9
20 Second opening of clasp shell 9
21 Hole of button
22 Elongated member
23 First end of cap
24 Spacing
25 Leg of push button 2
26 Main part of push button 2
27 Bottom part of push button 2
28 Attachment slot
29 First end of stopper 8
30 Barb of stopper 8
31 Slot
32 Leg of stopper 8
33 Beveled surface
34 Push surface
35 Lower surface
36 Button support surface
37 Cut-out
38 Tip part
39 Portion of reduced diameter
40 Cap part
41 Wall sections
42 Upper part of clasp shell 9
43 Knob leg
44 Exterior surface of clasp shell 9
45 Interior surface of clasp shell 9
46 First side of clasp shell 9
47 Second side of clasp shell 9
48 Interior surface of lower part 12 of clasp shell
49 Third side of clasp shell 9
50 Fourth side of clasp shell 9
51 Upper track end
52 Slot of leg 25

54 Snake chain
55 Opening for attachment of stopper
56 Tread
B Bracelet
L Length direction
P Push direction

The invention claimed is:

1. A jewelry clasp for securing a first end of an elongated member of a bracelet or a necklace to a second end of the elongated member, the jewelry clasp comprising:

a clasp shell enclosing a spacing, the clasp shell having a first opening for slidably receiving the first end of the elongated member for releasably securing the first end to the second end of the elongated member;

a spring-biased push button slidably received in the spacing through a second opening of the clasp shell, the button being slidable between a releasing state and a locking state so that the button can be pushed into the releasing state when a push force against a spring force is applied to the button, the button returning to the locking state by means of the spring force when the push force is released, wherein:

the push button has a hole for receiving the first end of the elongated member when the first end is received through the first opening of the clasp shell; and the push button has a stopper for engaging and locking the first end of the elongated member to the clasp when the first end is positioned in the hole and the push button is in the locking state, the stopper releasing the first end of the elongated member when the push button is in the releasing state; and a magnet inside the clasp shell, the magnet exerting a magnetic force which, when the first end of the elongated member includes a material magnetically attractable by the magnet, acts to pull said first end of the elongated member through the first opening and into the hole of the button when said first end is positioned in said first opening.

2. A jewelry clasp according to claim 1, wherein the magnet is positioned inside the spacing oppositely from the first opening, and said hole is a through-hole, whereby said first end of the elongated member is allowed to abut the magnet when inserted through the hole.

3. A jewelry clasp according to claim 1, wherein the stopper is a bracket with an inclined surface, the inclined surface in the locking position of the jewelry clasp being positioned at an entrance to the spacing from the first opening, so that insertion of said first end through the first opening will force the stopper towards the releasing state thereof, allowing insertion of said first end into said hole in the push button.

4. A jewelry clasp according to claim 1, wherein the push button returns by means of the spring bias to the locking state if the first end of the elongated member is not inserted or is fully inserted in the jewelry clasp.

5. A jewelry clasp according to claim 1, wherein the push button comprises a top part being positioned at least partly in the second opening in the locking state, and a bottom part positioned oppositely from top part, the bottom part and the top part being connected by one or more legs.

6. A piece of jewelry, such as a bracelet or a necklace, comprising:

a jewelry clasp according to claim 1; and an elongated member with a first and a second end;

wherein:

the first opening of the clasp shell is configured to slidably receive the first end of the elongated member to releasably secure the first end to the second end of the elongated member;

the hole of the push button is configured to receive the first end of the elongated member when the first end is received through the first opening of the clasp shell;

the stopper of the push button engages and locks the first end of the elongated member to the clasp when the first end is positioned in the hole and the push button is in the locking state, and the stopper releases the first end of the elongated member when the push button is moved from the locking state to the releasing state; and the first end of the elongated member comprises a material attractable by the magnet in the spacing so that when the first end is received in the first opening of the clasp shell, the magnet exerts a magnetic force which acts to pull the first end of the elongated member into the hole of the button.

7. A piece of jewelry according to claim 6, wherein the magnet is a first magnet positioned in the spacing, and the first end of the elongated member comprises a second magnet, the magnets attracting each other when the first end of the elongated member is inserted into the first opening.

8. A piece of jewelry according to claim 6, wherein said first end comprises a tip part with a front or tip end for facing in an insertion direction when inserting said first end into the jewelry clasp through the first opening, wherein the tip part further comprises a rear end which includes a step or cut-out, the stopper engaging and locking said first end when the first end is positioned in the hole and the push button is in the locking state by the stopper being inserted into said step or cut-out.

9. The jewelry clasp of claim 1, wherein the stopper selectively engages an inclined surface of the elongated member to thereby lock the first end of the elongated member to the clasp.

10. A jewelry clasp for securing a first end of an elongated member of a bracelet or a necklace to a second end of the elongated member, the jewelry clasp comprising:

a clasp shell enclosing a spacing, the clasp shell having a first opening for slidably receiving the first end of the elongated member for releasably securing the first end to the second end of the elongated member;

a spring-biased push button slidably received in the spacing through a second opening of the clasp shell, the button being slidable between a releasing state and a locking state so that the button can be pushed into the releasing state when a push force against a spring force is applied to the button, the button returning to the locking state by means of the spring force when the push force is released, wherein:

the push button has a hole for receiving the first end of the elongated member when the first end is received through the first opening of the clasp shell;

the push button has a top part being positioned at least partly in the second opening in the locking state, and a bottom part positioned oppositely from top part, the bottom part and the top part being connected by one or more legs; and the push button has a stopper for engaging and locking the first end of the elongated member to the clasp when the first end is positioned in the hole and the push button is in the locking state, the stopper releasing the first end of the elongated member when the push button is in the releasing state;

a magnet exerting a magnetic force which, when the first end of the elongated member includes a material magnetically attractable by the magnet, acts to pull said first end of the elongated member through the first opening and into the hole of the button when said first end is positioned in said first opening; and a button support surface fixed to the clasp shell, the button support surface being positioned below the top part of the push button, so that a bottom surface of the top part abuts the button support surface when the push button is in the releasing state.

11. A jewelry clasp for securing a first end of an elongated member of a bracelet or a necklace to a second end of the elongated member, the jewelry clasp comprising:

a clasp shell enclosing a spacing, the clasp shell having a first opening for slidably receiving the first end of the elongated member for releasably securing the first end to the second end of the elongated member;

a spring-biased push button slidably received in the spacing through a second opening of the clasp shell, the button being slidable between a releasing state and a locking state so that the button can be pushed into the releasing state when a push force against a spring force is applied to the button, the button returning to the locking state by means of the spring force when the push force is released, wherein:

the push button has a hole for receiving the first end of the elongated member when the first end is received through the first opening of the clasp shell; and the push button has a stopper for engaging and locking the first end of the elongated member to the clasp when the first end is positioned in the hole and the push button is in the locking state, the stopper releasing the first end of the elongated member when the push button is in the releasing state; and a magnet exerting a magnetic force which, when the first end of the elongated member includes a material magnetically attractable by the magnet, acts to pull said first end of the elongated member through the first opening and into the hole of the button when said first end is positioned in said first opening;

wherein an interior surface of the clasp shell comprises one or more tracks, in each of which a knob of the push button may slide when the push button slides between the releasing state and the locking state.

12. A jewelry clasp according to claim 11, wherein each track comprises a support element positioned at an end of the track to limit the sliding movement of the push button, so that the push button is prevented from being extracted from the spacing.

13. A jewelry clasp according to claim 11, wherein one said knob is positioned on one said leg of the push button, a U-shaped slot in the leg defining a resilient knob leg of the leg, said U-shaped slot making the knob leg flexible so that the knob can be pushed inwardly when inserting the push button into the jewelry clasp during assembly thereof.

14. A jewelry clasp for securing a first end of an elongated member of a bracelet or a necklace to a second end of the elongated member, the jewelry clasp comprising:

a clasp shell enclosing a spacing, the clasp shell having a first opening for slidably receiving the first end of the elongated member for releasably securing the first end to the second end of the elongated member;

a spring-biased push button slidably received in the spacing through a second opening of the clasp shell, the button being slidable between a releasing state and a locking state so that the button can be pushed into the releasing state when a push force against a spring force is applied to the button, the button returning to the locking state by means of the spring force when the push force is released, wherein:

the push button has a hole for receiving the first end of the elongated member when the first end is received through the first opening of the clasp shell; and the push button further comprises a stopper for engaging and locking the first end of the elongated member to the clasp when the first end is positioned in the hole and the push button is in the locking state, the stopper releasing the first end of the elongated member when the push button is in the releasing state; and a magnet exerting a magnetic force which, when the first end of the elongated member includes a material magnetically attractable by the magnet, acts to pull said first end of the elongated member through the first opening and into the hole of the button when said first end is positioned in said first opening;

wherein a knob is positioned on one said leg of the push button, a U-shaped slot in the leg defining a resilient knob leg of the leg, said U-shaped slot making the knob leg flexible so that the knob can be pushed inwardly when inserting the push button into the jewelry clasp during assembly thereof.

15. A piece of jewelry comprising:

an elongated member having a first end and a second end; and a jewelry clasp, the jewelry clasp comprising:

a clasp shell enclosing a spacing, the clasp shell having a first opening for slidably receiving the first end of the elongated member for releasably securing the first end to the second end of the elongated member; and a spring-biased push button slidably received in the spacing through a second opening of the clasp shell, the push button being slidable between a releasing state and a locking state so that the button can be pushed into the releasing state when a push force against a spring force is applied to the push button, the push button returning to the locking state by means of the spring force when the push force is released, wherein the push button has a hole for receiving the first end of the elongated member when the first end is received through the first opening of the clasp shell, and wherein the push button further comprises a rotating stopper engaging and locking the first end of the elongated member when the first end is positioned in the hole and the push button is in the locking state, the rotating stopper releasing the first end of the elongated member when the push button is in the releasing state; and a magnet positioned in the spacing or comprised in the first end of the elongated member;

wherein a material magnetically attractable by the magnet is included in that of the first end of the elongated member and the spacing which does not include the magnet, so that when the first end of the elongated member is positioned in said first opening, the magnet acts to pull said first end through the first opening and into the hole of the button.

16. A method for assembly of a jewelry clasp, the method comprising:

1) providing a clasp shell enclosing a spacing, the clasp shell having a first opening for slidably receiving a first end of an elongated member of a piece of jewelry for releasably securing the first end to the second end of the elongated member;

2) positioning a spring in a bottom part of a push button;

3) positioning the push button through a second opening of the clasp shell so that the push button is slidably received in the spacing through the second opening of the clasp shell, so that the button is slidable between a releasing state and a locking state and can be pushed into the releasing state when a push force against a spring force provided by the spring is applied to the push button, the push button returning to the locking state by means of the spring force of the spring when the push force is released, wherein the button has a hole for receiving the first end of the elongated member when the first end is received through the first opening of the clasp shell, wherein the button comprises a stopper for engaging and locking the first end of the elongated member when the first end is positioned in the hole and the button is in the locking state, the stopper releasing the first end of the elongated member when the button is in the releasing state, the stopper selectively engaging an inclined surface of the elongated member to thereby lock the first end of the elongated member to the clasp; and 4) positioning a magnet in the spacing, the magnet exerting a magnetic force which, when the first end of the elongated member includes a material magnetically attractable by the magnet, pulls said first end of the elongated member through the first opening and into the hole of the push button when said first end is positioned in said first opening.

17. A method for opening a piece of jewelry assembled according to the method of claim 16, comprising:

5) pushing the push button against the spring force by exerting a push force on a push surface of the button, whereby the stopper releases the first end of the elongated member; and 6) removing the first end of the elongated member by pulling the first end of the elongated member out of the hole of the button and out of the first opening of the clasp shell.

18. A method for closing a piece of jewelry assembled according to the method of claim 16, comprising:

5) Inserting the first end of the elongated member into the first opening of the clasp shell and into the hole of the push button, so that during this insertion the first end engages the stopper, whereby the insertion of the first end pushes the stopper from the locking state into the releasing state to allow the first end to be inserted into the hole of the push button.

19. A jewelry clasp for securing a first end of an elongated member of a bracelet or a necklace to a second end of the elongated member, the jewelry clasp comprising:

a clasp shell enclosing a spacing, the clasp shell having a first opening for slidably receiving the first end of the elongated member for releasably securing the first end to the second end of the elongated member;

a spring-biased push button slidably received in the spacing through a second opening of the clasp shell, the button being slidable between a releasing state and a locking state so that the button can be pushed into the releasing state when a push force against a spring force is applied to the button, the button returning to the locking state by means of the spring force when the push force is released, wherein:

the push button has a hole for receiving the first end of the elongated member when the first end is received through the first opening of the clasp shell; and the push button has a rotating stopper for engaging and locking the first end of the elongated member to the clasp when the first end is positioned in the hole and the push button is in the locking state, the stopper releasing the first end of the elongated member when the push button is in the releasing state; and a magnet exerting a magnetic force which, when the first end of the elongated member includes a material magnetically attractable by the magnet, acts to pull said first end of the elongated member through the first opening and into the hole of the button when said first end is positioned in said first opening.

20. A jewelry clasp according to claim 19, wherein the magnet is positioned inside the spacing oppositely from the first opening, and said hole is a through-hole, whereby said first end of the elongated member is allowed to abut the magnet when inserted through the hole.

21. A piece of jewelry, such as a bracelet or a necklace, comprising:

a jewelry clasp according to claim 19; and an elongated member with a first and a second end;

wherein:

the first opening of the clasp shell is configured to slidably receive the first end of the elongated member to releasably secure the first end to the second end of the elongated member;

the hole of the push button is configured to receive the first end of the elongated member when the first end is received through the first opening of the clasp shell;

the stopper of the push button engages and locks the first end of the elongated member to the clasp when the first end is positioned in the hole and the push button is in the locking state, and the stopper releases the first end of the elongated member when the push button is moved from the locking state to the releasing state; and the first end of the elongated member comprises a material attractable by the magnet in the spacing so that when the first end is received in the first opening of the clasp shell, the magnet exerts a magnetic force which acts to pull the first end of the elongated member into the hole of the button.

* * * * *